US012006663B2

(12) United States Patent
Kean

(10) Patent No.: US 12,006,663 B2
(45) Date of Patent: Jun. 11, 2024

(54) CALIBRATING MOUNTING MISALIGNMENTS OF SENSORS ON AN IMPLEMENT OF A WORK MACHINE USING SWING MOTION

(71) Applicant: Deere & Company, Moline, IL (US)

(72) Inventor: Michael G. Kean, Odense (DK)

(73) Assignee: Deere & Company, Moline, IL (US)

( * ) Notice: Subject to any disclaimer, the term of this patent is extended or adjusted under 35 U.S.C. 154(b) by 470 days.

(21) Appl. No.: 17/394,481

(22) Filed: Aug. 5, 2021

(65) Prior Publication Data

US 2023/0038266 A1 Feb. 9, 2023

(51) Int. Cl.

| | |
|---|---|
| ***E02F 9/26*** | (2006.01) |
| ***E02F 3/43*** | (2006.01) |
| ***E02F 3/84*** | (2006.01) |
| ***E02F 9/20*** | (2006.01) |

(52) U.S. Cl.
CPC ..... *E02F 9/264* (2013.01); *E02F 3/845* (2013.01); *E02F 9/2004* (2013.01)

(58) Field of Classification Search
CPC ..... E02F 9/264; E02F 3/845; E02F 9/2004; E02F 3/435
See application file for complete search history.

(56) References Cited

U.S. PATENT DOCUMENTS

| | | | | |
|---|---|---|---|---|
| 4,111,066 | A | 9/1978 | Kendrick | |
| 6,044,308 | A * | 3/2000 | Huissoon | B25J 9/1692 700/254 |
| 6,477,914 | B1 | 11/2002 | Krieger | |
| 7,477,973 | B2 | 1/2009 | Brewer et al. | |
| 8,180,532 | B2 | 5/2012 | O'Halloran et al. | |
| 8,412,420 | B2 | 4/2013 | Ruhter et al. | |
| 8,424,632 | B2 | 4/2013 | Ruhter et al. | |
| 9,227,478 | B2 | 1/2016 | Horstman | |
| 9,637,889 | B2 | 5/2017 | Elkins | |
| 9,638,525 | B1 | 5/2017 | Willis | |
| 10,076,939 | B2 | 9/2018 | Simon et al. | |
| 10,401,176 | B2 | 9/2019 | Nackers et al. | |
| 10,532,741 | B2 | 1/2020 | Kean et al. | |
| 10,704,226 | B2 | 7/2020 | Yamaguchi et al. | |
| 10,704,233 | B2 | 7/2020 | Dusha | |

(Continued)

FOREIGN PATENT DOCUMENTS

WO 2008129345 A1 10/2008

*Primary Examiner* — Frederick M Brushaber
(74) *Attorney, Agent, or Firm* — Gary L. Montle; Lucian Wayne Beavers; Patterson Intellectual Property Law, PC

(57) ABSTRACT

A computer-implemented method of operating an implement for a work machine as disclosed herein includes a calibration mode and an operation mode. In the calibration mode: at least one of one or more components of the implement may be rotated about at least one linkage joint corresponding to the at least one of the one or more components into one or more poses; for the one or more poses, the implement may be revolved about a frame of the work machine; output signals may be received from at least one sensor associated with the at least one of the one or more components; and at least one characteristic for the at least one of the one or more components may be tracked. In the operation mode, movement of the at least one of the one or more components may be based in part on the tracked at least one characteristic.

20 Claims, 14 Drawing Sheets

(56) References Cited

U.S. PATENT DOCUMENTS

| | | | | |
|---|---|---|---|---|
| 2002/0013675 | A1* | 1/2002 | Knoll | B25J 9/1692<br>702/150 |
| 2014/0168009 | A1 | 6/2014 | Peake | |
| 2016/0214255 | A1* | 7/2016 | Uhlenbrock | B25J 9/1674 |
| 2018/0126553 | A1* | 5/2018 | Corkum | B25J 9/1697 |
| 2019/0100205 | A1 | 4/2019 | Kean et al. | |
| 2020/0054401 | A1* | 2/2020 | Yu | B25J 9/1633 |
| 2020/0054403 | A1* | 2/2020 | Zhou | A61B 34/30 |

* cited by examiner

Realigned Gyros Integrated
100
0
-100
0
100
200
300
400
500
600
700
800
900

Raw Gyros Integrated
100
0
-100
0
100
200
300
400
500
600
700
800
900

Discrepancy
20
10
0
0
100
200
300
400
500
600
700
800
900
Frame Pitch
Boom Angle
Arm Angle

CALIBRATING MOUNTING MISALIGNMENTS OF SENSORS ON AN IMPLEMENT OF A WORK MACHINE USING SWING MOTION

CROSS-REFERENCES TO RELATED APPLICATIONS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE DISCLOSURE

The present disclosure relates generally to work machines, such as construction and forestry machines, and more particularly to systems and methods of calibrating a mounting misalignment of sensors on at least one implement of a work machine using swing motion.

BACKGROUND

Work machines of the present disclosure may for example include excavator machines, loaders, crawlers, motor graders, backhoes, forestry machines, front shovel machines, and others. These work machines may typically have ground engaging units (typically, e.g., tracks or wheels) supporting the undercarriage from the ground surface. These work machines may further include a work implement, which may comprise a single component moveable with respect to a main frame of the work machine, or may include a plurality of components moveable with respect to the main frame and further relative to each other, that is used to selectively modify the terrain in coordination with movement of the work machine.

There is an ongoing need in the field of such work machines for solutions that provide accurate orientation for the one or more components of the work implement. Conventional algorithms designed to ascertain a position or orientation of the one or more components of the work implement with respect to a linkage joint using a sensor system, such as a system of inertial measurement units (IMUs), are a poor solution for work machines, particularly where there may be a mounting misalignment of the sensor system on the one or more components due to manufacturing variations in the construction of the one or more components or where the work machine is subject to dynamic conditions. These algorithms incorporate sensor fusion and integration of readings or inputs from the sensor system to estimate an angle of the one or more components of the implement with respect to the linkage joint, so as to ascertain the position or orientation of the one or more components of the implement of the work machine.

There are, however, known disadvantages to such algorithms. For example, algorithms that incorporate sensor fusion and integration of readings or inputs from the sensor system to estimate the angle of the one or more components of the implement with respect to the linkage joint do not account for a swing motion of the work machine. A linkage motion is generally defined as a rotation of the one or more components of the implement about an axis defined by the linkage joint. A swing motion, on the other hand, is generally defined as a revolution of the implement about a main frame of the work machine. In conventional sensor systems based on IMUs, the IMUs may include a three-axis accelerometer and a three-axis gyroscope. Current sensor fusion algorithms integrate measurements from the gyroscope to predict changes in orientation of the one or more components of the implement while measurements from the accelerometer predict the then-current orientation of the one or more components of the implement. The gyroscope and accelerometer work in concert, with the gyroscope most actively sensing during movement of the one or more components of the implement and the accelerometer most actively sensing while the one or more components of the implement are at rest.

Due to a mounting misalignment of the sensor system on the one or more components of the implement, the swing motion of the implement may be perceived (or sensed) by the sensor system as the linkage motion of the one or more components of the implement. This is particularly problematic for the gyroscope of the IMU, which most actively senses output signals during movement of the one or more components of the implement. Where the swing motion of the implement is perceived (or sensed) by the sensor system as the linkage motion of one or more components of the implement, an error associated with the mounting misalignment of the sensors may yield errors with respect to not only error about a roll angle and a yaw angle, but also error about the pitch angle.

These potential errors are especially problematic for work machines, such as excavators, that are capable of employing high-speed swing motions, including rotational speeds of around twelve (12) to fifteen (15) revolutions per minute (RPM), corresponding to ninety degrees (90°) per second. For example, where the gyroscope of the IMU measures at least 1% of the rotational speed associated with the swing motion with angle or orientation of around 0.6 degrees, then the integration and fusion of the sensor-system measurements may cause a drift of around 0.9 degrees per second. This, in turn, may yield significant error because either the sensor fusion and integration will not reject the error, thereby providing an incorrect orientation or position of the one or more components of the implement, or the sensor fusion and integration will identify the perceived swing motion as linkage motion, causing the integration and sensor fusion to yield additional error.

At least in view of the aforementioned limitations in existing algorithms designed to ascertain a position or orientation of the one or more components of the work implement with respect to the linkage joint using the sensor system, it would be desirable to provide a system and method of calibrating the sensor system on the one or more components of the work implement of the work machine where the one or more components of the work implement experience or undertake the linkage motion and/or the swing motion.

BRIEF SUMMARY

The current disclosure provides an enhancement to conventional systems for work machines, at least in part by introducing a novel system and method for calibrating a sensor system on the one or more components of the implement, where the one or more components of the implement undergo a rotation about at least one linkage joint associated with at least one of the one or more components of the implement and the implement undergoes a revolution about an axis generally orthogonal to a main frame of the work machine. The current disclosure provides a calibration scheme that uses information received from a swing motion of the implement to identify a mounting misalignment of the sensor system that may occur either due to manufacturing variations in the construction of the one or more components or where the work machine is subject to dynamic conditions.

In the context of methods for operating an implement for a work machine, certain embodiments of a computer-implemented method are disclosed. The implement may be coupled to a frame of the work machine, and the implement may include one or more components. The computer-implemented method may comprise a step associated with a calibration mode and a step associated with an operation mode. In the calibration mode, a position of at least one of the one or more components may be calibrated. A sensor system, which may include inertial measurement units (each, an "IMU"), may be mounted or affixed on the at least one of the one or more components. Each IMU may contain a variety of sensors, including a gyroscope, an accelerometer, or a magnetometer. The at least one sensor of the sensor system may be associated with the at least one of the one or more components of the implement, where the at least one of the one or more components of the implement may correspond to at least one linkage joint. In the calibration mode, the at least one of the one or more components of the implement may be rotated about an axis defined by the corresponding at least one linkage joint into one or more poses. For each of the one or more poses, at least one revolution of the implement about an axis generally orthogonal to the frame of the work machine may be performed. Further, in the calibration mode, output signals having sense elements may be received from at least one sensor of the sensor system, the sense elements of which may include a plurality of angular velocity measurements. Based upon at least a portion of the sense elements from the received output signals from the at least one sensor of the sensor system, at least one characteristic for the at least one or more components of the implement may be tracked. The at least one characteristic may be an orientation or configuration of the at least one of the one or more components of the implement with respect to the corresponding at least one linkage joint. In the operation mode, movement of the at least one of the one or more components of the implement may be directed based at least in part of the tracked at least one characteristic for the at least one of the one or more components of the implement. Either (or both) the calibration mode or the operation mode may be selected by a user-initiated selection.

In the context of a work machine, the work machine may include an implement configured for working terrain. The implement may be coupled to a frame of the work machine and the implement may have one or more components, wherein at least one of the one or more components of the implement corresponds to at least one linkage joint. A sensor system, which may include IMUs, may be mounted or affixed on the at least one of the one or more components. The IMU may contain a variety of sensors, including a gyroscope, an accelerometer, or a magnetometer. At least one sensor of the sensor system may be associated with at least one of the one or more components of the implement. A controller may be functionally linked to the at least one sensor of the sensor system, and further, the controller may be operable between a calibration mode and an operation mode. In the calibration mode, the controller may be configured to: rotate the at least one of the one or more components of the implement about an axis defined by the corresponding at least one linkage joint into one or more poses; for each of the one or more poses, perform at least one revolution of the implement about an axis generally orthogonal to the frame of the work machine; receive output signals having sense elements from the at least one sensor, the sense elements of which may include plurality of angular velocity measurements; and track at least one characteristic based upon at least a portion of the sense elements from the received output signals for the at least one of the one or more components of the implement, wherein said at least one characteristic may include an orientation of the at least one of the one or more components of the implement with respect to the corresponding at least one linkage joint. In the operation mode, the controller may be configured to direct movement of the at least one or more components of the implement based at least in part on the tracked at least one characteristic for the at least one of the one or more components of the implement. Either (or both) the calibration mode or the operation mode may be selected by a user-initiated selection.

In one particular and exemplary embodiment, a computer-implemented method of operating an implement for a work machine is provided, the implement coupled to a frame of the work machine and the implement having one or more components. The method may commence with a step of calibrating a position of at least one of the one or more components of the implement. The step of calibrating the position of the at least one of the one or more components of the implement proceeds as follows. At least one sensor is associated with the at least one of the one or more components of the implement, where the at least one of the one or more components of the implement correspond to at least one linkage joint. The at least one of the one or more components of the implement are rotated about an axis defined by the corresponding at least one linkage joint into one or more poses. For each of the one or more poses, at least one revolution of the implement is performed about an axis generally orthogonal to the frame of the work machine. Output signals are received from the at least one sensor, the output signals comprising sense elements. At least one characteristic is tracked based upon at least a portion of the sense elements from the received output signals for the at least one of the one or more components of the implement. The method may continue with a step of directing movement of the at least one of the one or more components of the implement. The movement of the at least one of the one or more components of the implement is based at least in part on the tracked at least one characteristic for the at least one of the one or more components of the implement.

In one aspect according to the above-referenced embodiment, the method may further comprise enabling a user-initiated selection of a calibration mode corresponding to the step of calibrating the position of the at least one of the one or more components of the implement.

In another aspect according to the above-referenced embodiment, the method may further comprise enabling a user-initiated selection of an operation mode corresponding to the step of directing movement of the at least one of the one or more components of the implement.

In another aspect according to the above-referenced embodiment, the method may further comprise enabling a user-initiated selection of a calibration mode corresponding to the step of calibrating the position of the at least one of the one or more components of the implement and enabling a user-initiated section of an operation mode corresponding to the step of directing movement of the at least one of the one or more components of the implement.

In another aspect according to the above-referenced embodiment, the at least one characteristic may comprise an orientation of the at least one of the one or more components of the implement with respect to the corresponding at least one linkage joint.

In another aspect according to the above-referenced embodiment, the step of directing movement of the at least one of the one or more components of the implement may further comprise directing movement of the at least one of the one or more components of the implement based at least in part on the orientation of the at least one of the one or more components of the implement with respect to the corresponding at least one linkage joint.

In another aspect according to the above-referenced embodiment, the sense elements may comprise a plurality of angular velocity measurements. The step of calibrating the position of the at least one of the one or more components may further comprise tracking the at least one characteristic based upon at least a portion of the plurality of angular velocity measurements.

In another aspect according to the above-referenced embodiment, the sense elements may comprise a plurality of angular velocity measurements. The step of calibrating the position of the at least one of the one or more components may further comprise tracking the at least one characteristic by identifying maximum angular velocity measurements and minimum angular velocity measurements based at least in part on the plurality of angular velocity measurements.

In another aspect according to the above-referenced embodiment, the step of calibrating the position of the at least one of the one or more components may further comprise rotating the at least one of the one or more components of the implement about the axis defined by the corresponding at least one linkage joint into at least two of the one or more poses.

In another aspect according to the above-referenced embodiment, the step of calibrating the position of the at least one of the one or more components may further comprise, for each of the at least two of the one or more poses, performing at least two of the at least one revolution of the implement about the axis generally orthogonal to the frame of the work machine.

In another aspect according to the above-referenced embodiment, the step of calibrating the position of the at least one of the one or more components may further comprise rotating the at least one of the one or more components of the implement about the axis defined by the corresponding at least one linkage joint into at most two of the one or more poses.

In another aspect according to the above-referenced embodiment, the step of calibrating the position of the at least one of the one or more components may further comprise, for each of the at most two of the one or more poses, performing at least two of the at least one revolution of the implement about the axis generally orthogonal to the frame of the work machine.

In another aspect according to the above-referenced embodiment, the step of calibrating the position of the at least one of the one or more components may further comprise, for each of the one or more poses, performing at least two of the at least one revolution of the implement about the axis generally orthogonal to the frame of the work machine.

In another aspect according to the above-referenced embodiment, the step of calibrating the position of the at least one of the one or more components may further comprise performing a first of the at least one revolution of the implement about the axis generally orthogonal to the frame at a rate of around one revolution per minute (RPM) or less.

In another aspect according to the above-referenced embodiment, the step of calibrating the position of the at least one of the one or more components may further comprise performing a second or more of the at least one revolution of the implement about the axis generally orthogonal to the frame at a rate greater than around one revolution per minute (RPM).

In another aspect according to the above-referenced embodiment, the implement may comprise a first of the one or more components having a first end coupled to the frame of the work machine at a first of the at least one linkage joint, and a second of the one or more components coupled to a second end of the first of the one or more components at a second of the at least one linkage joint.

In another aspect according to the above-referenced embodiment, the step of calibrating the position of the at least one of the one or more components may further comprise rotating the first of the one or more components about an axis defined by the first of the at least one linkage joint into a first of the one or more poses.

In another aspect according to the above-referenced embodiment, the step of calibrating the position of the at least one of the one or more components may further comprise, for the first of the one or more poses, performing at least one revolution of the implement about the axis generally orthogonal to the frame of the work machine.

In another aspect according to the above-referenced embodiment, the step of calibrating the position of the at least one of the one or more components may further comprise rotating the first of the one or more components about an axis defined by the first of the at least linkage joint into a first of the one or more poses, and rotating the second of the one or more components about an axis defined by the second of the at least one linkage joint into a second of the one or more poses.

In another aspect according to the above-referenced embodiment, the step of calibrating the position of the at least one of the one or more components may further comprise, for the first and second of the one or more poses, performing at least one revolution of the implement about the axis generally orthogonal to the frame of the work machine.

In another embodiment as disclosed herein, a work machine includes an implement configured for working terrain. The implement is coupled to a frame of the work machine, and the implement has one or more components. At least one of the one or more components of the implement corresponds to at least one linkage joint. At least one sensor is associated with the at least one of the one or more components of the implement. A controller is functionally linked to the at least one sensor, and the controller is operable between a calibration mode and an operation mode, during which steps according to the above-referenced method embodiment and various optional aspects may be performed.

Unless otherwise defined, all technical and scientific terms used herein have the same meaning as commonly understood by one of ordinary skill in the art to which this invention belongs. The present invention may be embodied in other specific forms without departing from the spirit or essential attributes thereof, and it is therefore desired that the present embodiment be considered in all aspects as illustrative and not restrictive. Any headings utilized in the description are for convenience only and no legal or limiting effect.

Numerous objects, features, and advantages of the embodiments set forth herein will be readily apparent to those skilled in the art upon reading of the following disclosure when taken in conjunction with the accompanying drawings.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected," "attached," "joined," "mounted," "fastened," and the like, or any variation thereof, should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; being integrally formed as a single part together; any mechanical fit such as a friction fit, interference fit, slidable fit, rotatable fit, pivotable fit, and the like; any combination thereof; and the like.

Referring now to FIGS. 1-8F, various embodiments may now be described of a system and method for operating a work implement 42 for a work machine 20, the work implement 42 coupled to a main frame 32 of the work machine 20 and having one or more components, wherein such method comprises steps of calibrating a position of at least one of the one or more components of the work implement 42 and directing movement of the at least one of the one or more components of the work implement 42. More particularly, in referring to FIGS. 1-8F, various embodiments may now be described to systems and methods of calibrating a mounting misalignment of a sensor system 104 on the work implement 42 of the work machine 20 using swing motion.

Figure 1:
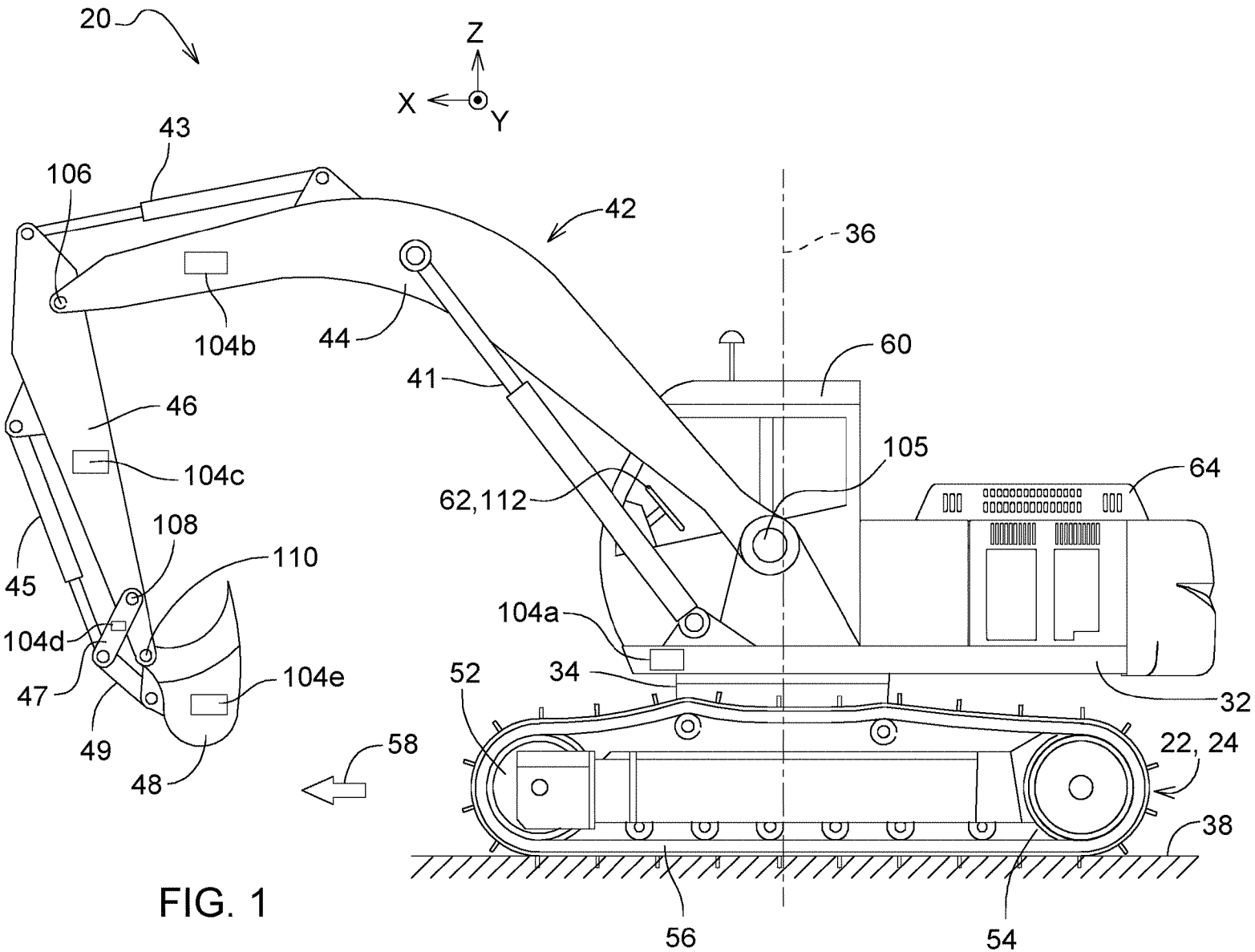
FIG. 1 is a side view representing an excavator as an exemplary work machine according to an embodiment of the present disclosure.

FIG. 1 depicts a representative work machine 20 in the form of, for example, a tracked excavator machine 20. For reference, an x-, y-, and z-axis coordinate system is defined for the work machine 20 and its numerous features, including the main frame 32, an undercarriage 22, and the work implement 42. The work machine 20 includes the undercarriage 22, the undercarriage 22 having first and second ground engaging units 24 including first and second travel motors (not shown) for driving the first and second ground engaging units 24, respectively. The main frame 32 is supported from the undercarriage 22 by a swing bearing 34 such that the main frame 32 may be pivotable about a pivot axis 36 relative to the undercarriage 22. Where the main frame 32 is pivotable about the pivot axis 36 relative to the undercarriage 22, the work implement 42 may also be pivotable about the pivot axis 36. The pivot axis 36 may be generally orthogonal to the main frame 23 of the work machine 20. Otherwise stated, the pivot axis 36 is substantially vertical when a ground surface 38 engaged by the ground engaging units 24 is substantially horizontal. A swing motor (not shown) is configured to pivot or swing the main frame 32 on the swing bearing 34 about the pivot axis 36 relative to the undercarriage 22.

The work implement 42 in the context of the referenced work machine 20 is a boom assembly 42 having one or more components. Pivoting or swinging the work implement 42 about the pivot axis 36 relative to the undercarriage 22 may be referred to as a "swing motion" of the work implement 42. The "swing motion" may constitute a revolution about the pivot axis 36, which is generally aligned along a z-axis of defined coordinate system, otherwise referred to as a yaw about the pivot axis 36.

The one or more components of the work implement 42 may be pivotably connected by at least one linkage joint. For example, the work implement 42 may include a boom 44 pivotably connected to the main frame 32 at a linkage joint 105, an arm 46 pivotally connected to the boom 44 at a linkage joint 106, and a working tool 48 pivotally connected to the arm 46 at a linkage joint 110. The working tool 48 in this embodiment is an excavator shovel 48 or a bucket 48, which is pivotally connected to the arm 46 at the linkage joint 110. One end of a dogbone 47 is pivotally connected to the arm 46 at a linkage joint 108, and another end of the dogbone 47 is pivotally connected to a tool link 49. The tool link 49 in the context of the referenced work machine 20 is a bucket link 49. For reference, a "linkage motion" may constitute a movement of the work implement 42 in the direction of the x-z coordinates, including an extension and/or contraction of the boom 44 and/or the arm 46.

"Linkage motion" may also constitute a rotation of the one or more components about an axis defined by any one of the linkage joint 105, the linkage joint 106, the linkage joint 108, or the linkage joint 110, or any combination thereof. The "linkage motion" may constitute a rotation about an axis orthogonal to a plane defined by x-z space in the defined coordinate system.

The boom assembly 42 extends from the main frame 32 along a working direction of the boom assembly 42. The working direction can also be described as a working direction of the boom 44. The working direction is generally defined as extending in the x-z coordinate space, in accordance with the defined coordinate system. As described herein, control of the work implement 42 may relate to control of any of the one or more components (e.g., the boom 44, the arm 46, and/or the tool 48).

The sensor system 104 is mounted on the work machine 20; in the context of the disclosure herein, the sensor system 104 may include multiple sensors, including a sensor 104*a*, a sensor 104*b*, a sensor 104*c*, a sensor 104*d*, and a sensor 104*e* mounted to the main frame 32, the boom 44, the arm 46, the dogbone 47, and the tool 48, respectively. The sensor system 104 in the context of the referenced work machine 20 may constitute a system of inertial measurement units (each, an IMU).

In the embodiment of FIG. 1, the first and second ground engaging units 24 are tracked ground engaging units. Each of the tracked ground engaging units 24 includes a front idler 52, a drive sprocket 54, and a track chain 56 extending around the front idler 52 and the drive sprocket 54. The travel motor of each tracked ground engaging unit 24 drives its respective drive sprocket 54. Each tracked ground engaging unit 24 has a forward traveling direction 58 defined from the drive sprocket 54 toward the front idler 52. The forward traveling direction 58 of the tracked ground engaging units 24 also defines the forward traveling direction 58 of the undercarriage 22 and thus of the working machine 20.

An operator's cab 60 may be located on the main frame 32. The operator's cab 60 and the boom assembly 42 may both be mounted on the main frame 32 so that the operator's cab 60 faces in the working direction 58 of the boom assembly 42. A control station 62 may be located in the operator's cab 60.

Also mounted on the main frame 32 is an engine 64 for powering the working machine 20. The engine 64 may be a diesel internal combustion engine. The engine 64 may drive a hydraulic pump to provide hydraulic power to the various operating systems of the working machine 20.

Figure 2:
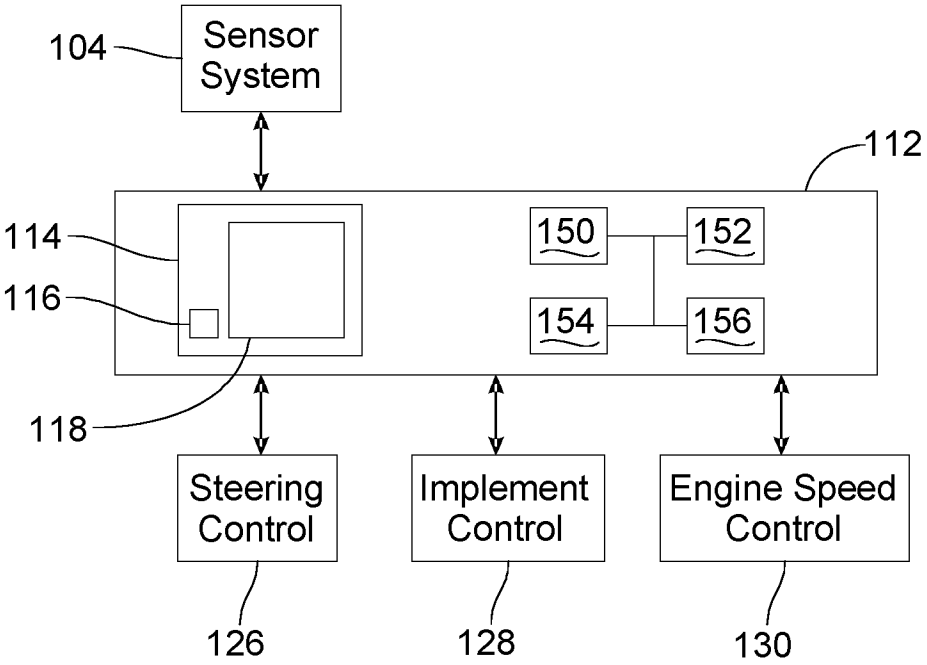
FIG. 2 is a block diagram representing an exemplary control system according to an embodiment of the present disclosure.

As schematically illustrated in FIG. 2, the work machine 20 includes a control system having a controller 112. The controller 112 may be part of the machine control system of the work machine 20, or it may be a separate control module. The controller 112 may include a user interface 114 and optionally be mounted in the operator's cab 60 at the control station 62.

The controller 112 is configured to receive input signals from some or all of various sensors collectively defining a sensor system 104, individual examples of which may be described below. Various sensors on the sensor system 104 may typically be discrete in nature, but signals representative of more than one input parameter may be provided from the same sensor, and the sensor system 104 may further refer to signals provided from the machine control system.

The sensor system 104 in the context of the self-propelled vehicle 20 may constitute a system of inertial measurement units (each, an IMU). IMUs are tools that capture a variety of motion- and position-based measurements, including, but not limited to, velocity, acceleration, angular velocity, and angular acceleration.

IMUs may include any of numerous sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU.

The controller 112 may be configured to produce outputs, as further described below, to the user interface 114 for display to a human operator. The controller 112 may further be configured to generate control signals for controlling the operation of respective actuators, or signals for indirect control via intermediate control units, associated with a machine steering control system 126, a machine implement control system 128, and an engine speed control system 130. The controller 112 may, for example, generate control signals for controlling the operation of various actuators, such as hydraulic motors or hydraulic piston-cylinder units 41, 43, and 45, and electronic control signals from the controller 112 may actually be received by electro-hydraulic control valves associated with the actuators such that the electro-hydraulic control valves will control the flow of hydraulic fluid to and from the respective hydraulic actuators to control the actuation thereof in response to the control signal from the controller 112.

The controller 112 may include, or be associated with, a processor 150, a computer readable medium 152, a communication unit 154, a data storage 156 such as for example a database network, and the aforementioned user interface 114 (or control panel 114) having a display 118. An input/output device 116, such as a keyboard, joystick, or other user interface tool 116, is provided so that the human operator may input instructions to the controller 112. It is understood that the controller 112 described herein may be a single controller having all of the described functionality, or it may include multiple controllers wherein the described functionality is distributed among the multiple controllers.

Various "computer-implemented" operations, steps, or algorithms, as described in connection with the controller 112 or alternative but equivalent computing devices or systems, can be embodied directly in hardware, in a computer program product such as a software module executed by the processor 150, or in a combination of the two. The computer program product can reside in RAM memory, flash memory, ROM memory, EPROM memory, EEPROM memory, registers, hard disk, a removable disk, or any other form of computer-readable medium 152 known in the art. An exemplary computer-readable medium 152 can be coupled to the processor 150 such that the processor 150 can read information from, and write information to, the computer-readable medium 152. In the alternative, the computer-readable medium 152 can be integral to the processor 150. The processor 150 and the computer-readable medium 152 can reside in an application specific integrated circuit (ASIC). The ASIC can reside in a user terminal. In the alternative, the processor 150 and the computer-readable medium 152 can reside as discrete components in a user terminal.

The term "processor" 150 as used herein may refer to at least general-purpose or specific-purpose processing devices and/or logic as may be understood by one of skill in the art, including but not limited to a microprocessor, a microcontroller, a state machine, and the like. The processor 150 can also be implemented as a combination of computing devices, e.g., a combination of a digital signal processor (DSP) and a microprocessor, a plurality of microprocessors, one or more microprocessors in conjunction with a DSP core, or any other such configuration.

The communication unit 154 may support or provide communications between the controller 112 and external systems or devices, and/or support or provide communication interface with respect to internal components of the self-propelled work machine 20. The communications unit 154 may include wireless communication system components (e.g., via cellular modem, WiFi, Bluetooth, or the like) and/or may include one or more wired communications terminals such as universal serial bus ports. The data storage 156 as further described below may, unless otherwise stated, generally encompass hardware such as volatile or non-volatile storage devices, drives, memory, or other storage media, as well as one or more databases residing thereon.

Referring to FIG. 1, the sensor system 104 may be mounted on or more components of the work machine 20. The sensor 104*a* is mounted on the main frame 32; the sensor 104*b* is mounted on the boom 44; the sensor 104*c* is mounted on the arm 46; the sensor 104*d* is mounted on the dogbone 47; and the sensor 104*e* is mounted on the tool 48. At least one sensor of the sensor system 104 may be mounted on opposing sides of at least one linkage joint, the at least one linkage joint of which may include the linkage joint 105, the linkage joint 106, the linkage joint 108, and the linkage joint 110. An opposing side of the at least one linkage joint may be ascertained by mounting or affixing the sensor system 104 on either side of the at least one linkage joint, which is defined as a pivotal linkage joint connecting the one or more components of the work implement 42. For example, the at least one linkage joint may be defined at the linkage joint 105, which constitutes a pivotal connection between the boom 44 and the main frame 32. As another example, the at least one linkage joint may be defined at the linkage joint 106, which constitutes a pivotal connection of the boom 44 and the arm 46. As yet another example, the at least one linkage joint may be defined at the linkage joint 108, which constitutes a pivotal connection of the arm 46 to the dogbone 47. And, as a further example, the at least one linkage joint may be defined at the linkage joint 110, which constitutes a pivotal connection between the arm 46 and the tool 48.

In the context of the work machine 20 disclosed herein, the sensor system 104 may constitute a system of IMUs. As previously set forth herein, IMUs are tools that capture a variety of motion- and position-based measurements using a number of sensors including, but not limited to, accelerometers and gyroscopes. IMUs may combine a three-axis accelerometer with a three-axis gyroscope. An accelerometer is an electro-mechanical device or tool used to measure acceleration ($m/s^2$), which is defined as the rate of change of velocity (m/s) of an object. Accelerometers sense either static forces (e.g., gravity) or dynamic forces of acceleration (e.g., vibration and movement). The accelerometer may receive sense elements measuring the force due to gravity. By measuring the quantity of static acceleration due to gravity of the Earth, the accelerometer may provide data as to the angle the object is tilted with respect to the Earth, the angle of which may be established in an x-, y-, and z-axis coordinate frame. However, where the object is accelerating in a particular direction, such that the acceleration is dynamic (as opposed to static), the accelerometer produces data which does not effectively distinguish the dynamic forces of motion from the force due to gravity by the Earth. A gyroscope is a device used to measure changes in orientation, based upon the object's angular velocity (rad/s or degree/s) or angular acceleration ($rad/s^2$ or $degree/s^2$). The gyroscope may constitute a mechanical gyroscope, a micro-electro-mechanical system (MEMS) gyroscope, a ring laser gyroscope, a fiber-optic gyroscope, and/or other gyroscopes as are known in the art. Principally, the gyroscope is employed to measure changes in angular position of an object in motion, the angular position of which may be established in an x-, y-, and z-axis coordinate frame.

Figure 3:
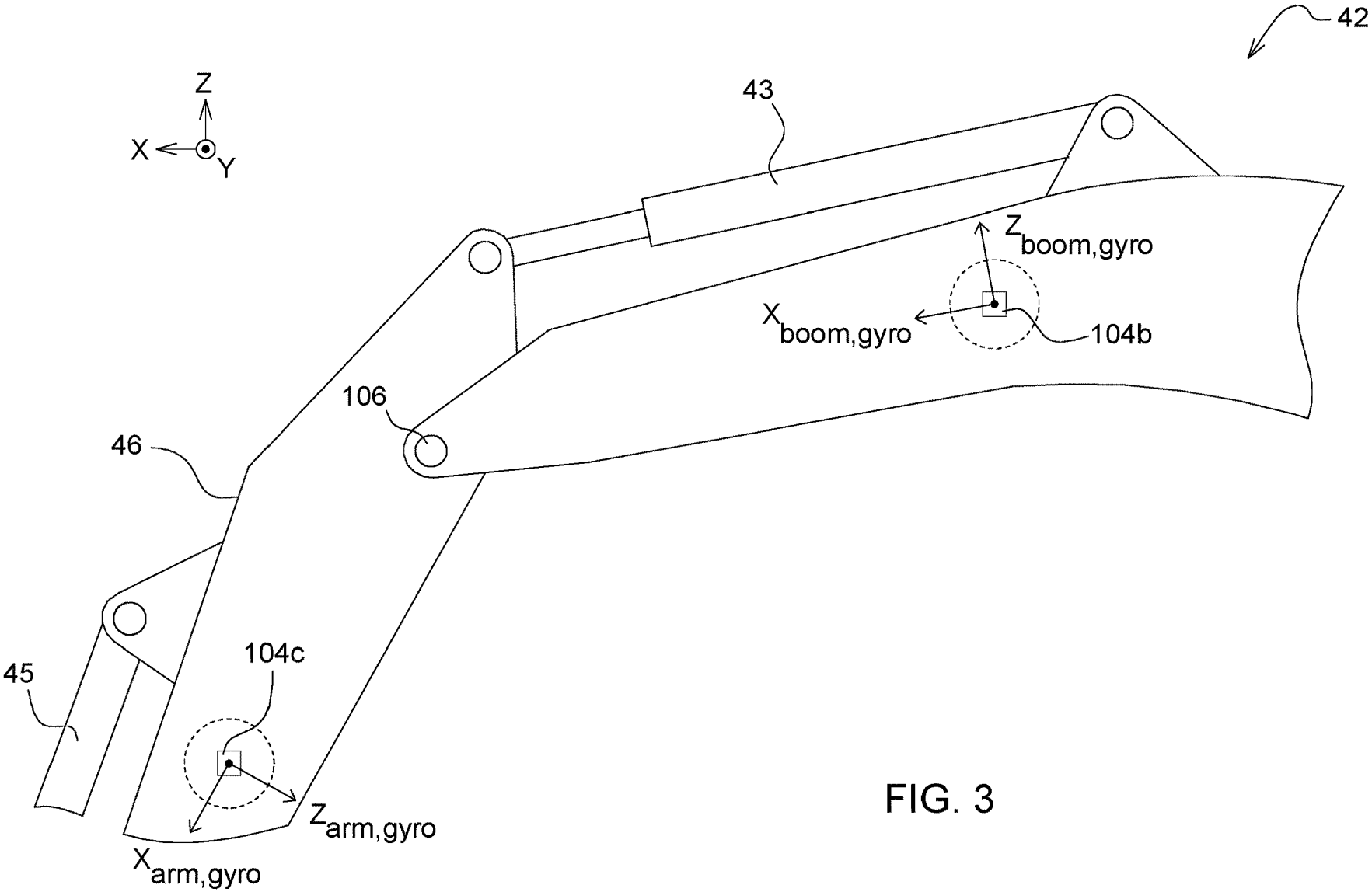
FIG. 3 is a side view representing a boom assembly of an excavator, the boom assembly of which is an exemplary implement for a work machine according to an embodiment of the present disclosure.

Referring to FIG. 3, a side view depicting the work implement 42, or the boom assembly 42, having the boom 44 and the arm 46 is depicted. The at least one linkage joint may be defined at the linkage joint 106, which constitutes a pivotal connection of the arm 46 and the boom 44. The sensor system 104 may be mounted in such a manner that the opposing sides of the at least one linkage joint are defined as follows: the sensor 104*c* is mounted on the arm 46 and the sensor 104*b* is mounted on the boom 44 and opposing the sensor 104*c*. As further set forth in the context of the disclosure of FIG. 3, an x-, y-, and z-axis coordinate system is defined for the work implement 42 and the sensor system 104. Moreover, FIG. 3 illustratively conveys a body frame of the sensor 104*b* and the sensor 104*c* mounted such that the x-axes of the aforementioned body frames point in the direction along the extension or contraction of the work implement 42, or as previously stated, the working direction of the work implement 42. FIG. 3 further discloses the body frame of the sensor 104*b* and the body frame of the sensor 104*c* mounted such that the z-axes of the aforementioned body frames point in a direction perpendicular to the x-axes; the z-axes of the aforementioned body frames may point in a direction of the main frame 32 of the work machine 20 or the ground surface 38, or away from the main frame 32 of the work machine 20 or the ground surface 38. Because an x-, y-, and z-axis coordinate system may be defined arbitrarily, the foregoing is not intended as limiting. The x-, y-, and z-axis coordinate system, though it may be defined arbitrarily, relates to or provides basis for the mechanical axes of rotation for roll (i.e., rotation about the x-axis), pitch (i.e., rotation about the y-axis), and yaw (i.e., rotation about the z-axis).

Figure 4B:
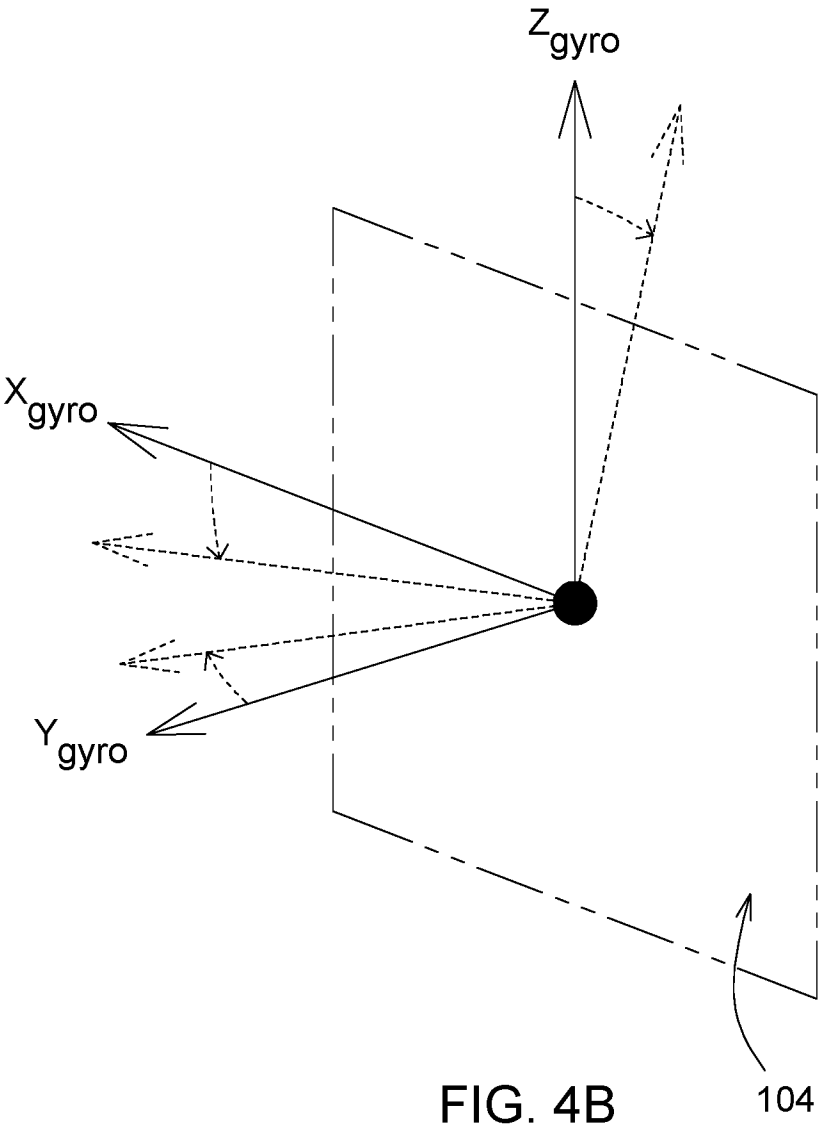
FIGS. 4A and 4B are graphical diagrams of the x-, y-, and z-axis coordinates of sensors mounted on one or more components of an implement as part of a boom assembly of an excavator according to an embodiment of the present disclosure.
Figure 4A:
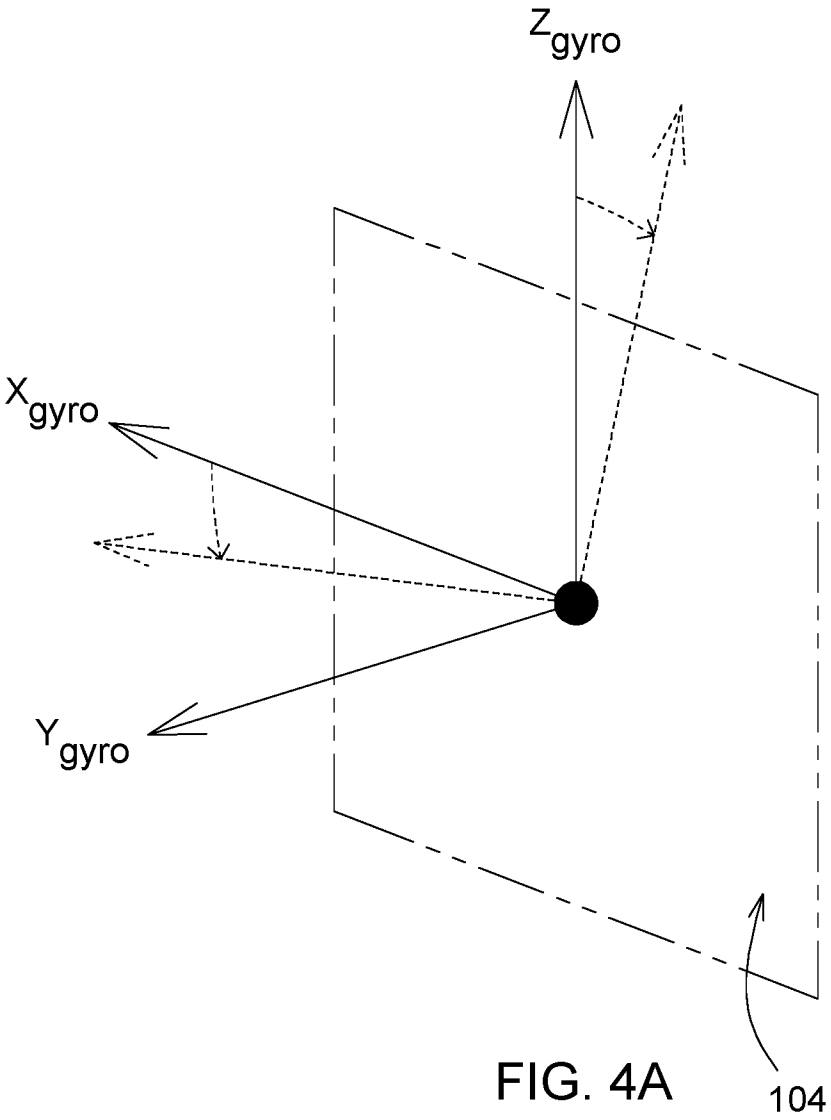
Figures 5A, 5B, 5C:
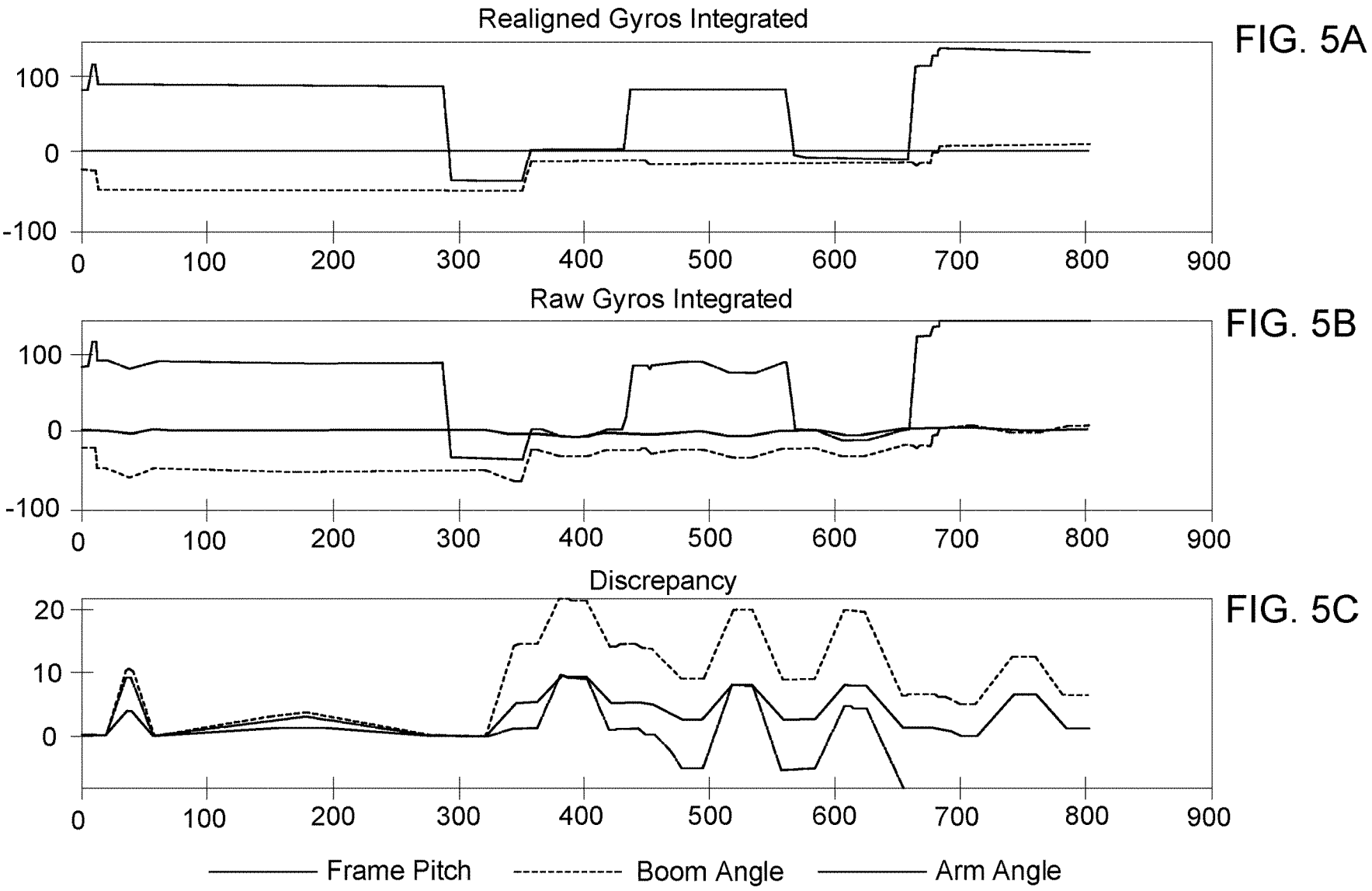
FIGS. 5A-5C are graphs conveying an orientation of a boom, an arm, and a work frame of an excavator as an exemplary work machine according to an embodiment of the present disclosure.

Referring to FIGS. 4A-4B, graphical diagrams of the x-, y-, and z-axis coordinates of the sensor system 104 mounted on work implement 42, such as the sensor 104*b* is mounted on the boom 44 and/or the sensor 104*c* mounted on the arm 46, are depicted. As illustrated in FIG. 4A, the gyroscope of the sensor 104*b* or sensor 104*c* may be positioned such that the x-axis points in the direction along the work implement 42 or in the working direction of the work implement 42. The z-axis of the gyroscope of the sensor 104*b* or the sensor 104*c* may point in a direction perpendicular to the x-axis; the z-axes of the gyroscope may point in a direction of the main frame 32 of the work machine 20 or the ground surface 38, or away from the main frame 32 of the work machine 20 or the ground surface 38. As shown in FIG. 4A, when operating or moving the work implement 42 in the x-z direction, there are differences in angles, orientation, or angular velocity about the x-axis and z-axis. However, where there is a mounting misalignment of the sensor system 104 on one or more components of the work implement 42, such as the boom 44 or the arm 46, whether caused by manufacturing variations in the construction of the one or more components or where the work machine 20 is subject to dynamic conditions, the mounting misalignment of the sensor system 104 may yield errors with respect to not only error about a roll angle (rotation about the x-axis) and a yaw angle (rotation about the z-axis), but also an error about a yaw angle (rotation about the y-axis). The coordinate system of FIG. 4B, unlike the coordinate system of FIG. 4A, demonstrates an excitation of not only the x-axis and the z-axis, but also the y-axis of the gyroscope in the sensor system 104, including the sensor 104*b* and 104*c*. The swing motion of the work implement 42 may be perceived (or sensed) by the sensor system 104 as the linkage motion of the one or more components of the work implement 42. Thus, the graphical diagram of the coordinates of the gyroscope in FIG. 4B evinces movement in the x-y-z space with roll (rotation about the x-axis), yaw (rotation about the z-axis), and the pitch (rotation about the y-axis).

Where the swing motion of the work implement 42 is perceived (or sensed) by the sensor system 104 as the linkage motion of the one or more components of the work implement 42, an error associated with the mounting misalignment of the sensor system 104 may yield errors with respect to not only error about a roll angle and a yaw angle, but also error about the pitch angle. Specifically, this yields significant error because either the fusion and integration of sense elements received from the sensor system 104 will not reject the error, thereby providing an incorrect orientation or position of the one or more components of the work implement 42, or the fusion and integration of sense elements received from the sensor system 104 will identify the perceived swing motion as linkage motion, causing the integration and sensor fusion to yield additional error. This error is evidenced in FIGS. 5A-5C, which depict a pitch about the main frame 32 and an orientation or angle of the boom 44 and the arm 46. In FIG. 5B, a graph containing raw data of measurements of angular velocity sensed and collected by the gyroscope is depicted. As evident when analyzing the orientation and angle of the boom 44 and the arm 46 with respect to the main frame 32, there is erratic motion about the pitch (rotation about the y-axis) of the main frame 32. The error perceived by the pitch of the main frame 32 may yield around 0.5 degrees per second of perceived angular velocity, for which the accelerator of the IMU may not correct the perceived angular velocity. In FIG. 5A, a graph containing calibrated data of measurements of angular velocity sensed and collected by the gyroscope is depicted. Given that the gyroscope in the sensor system 104 of FIG. 5A calibrated to account the pitch (rotation about the y-axis) of the main frame 32, there appears little to no erratic motion of the main frame 32 with respect to the boom 44 and the arm 46. In FIG. 5C, a graph comparing the data of measurements of angular velocity between the graphical data of FIGS. 5A and 5B is illustrated. While there remains discrepancy of measurements in the angle or orientation of the boom 44 and the arm 46, the graph importantly conveys the difference of perceived motion of the pitch of the main frame 32 as between a calibrated gyroscope and a non-calibrated (raw) gyroscope in the sensor system 104.

Figure 6:
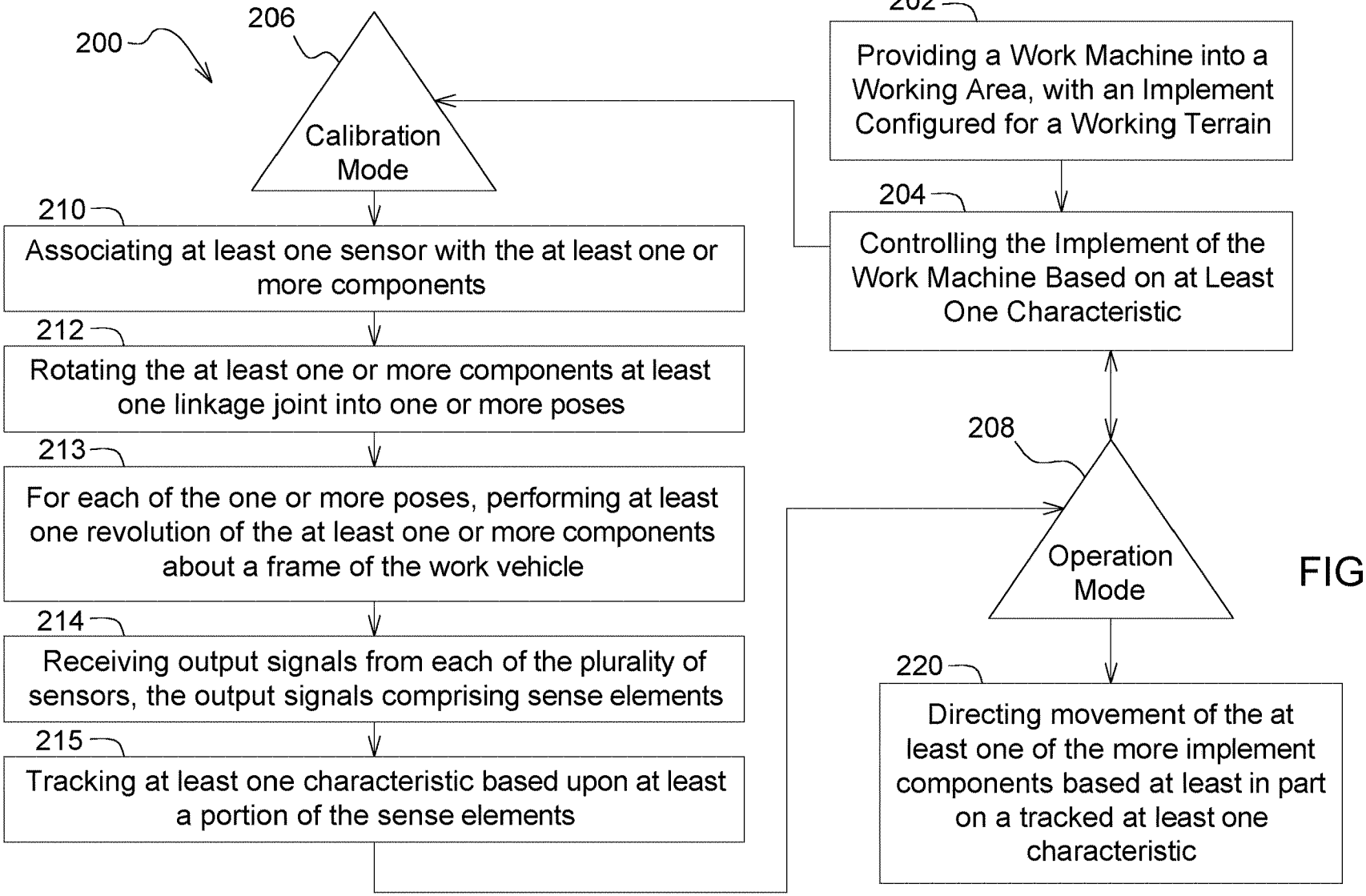
FIG. 6 is a flowchart representing an exemplary embodiment of a method in accordance with the present disclosure.

Referring to FIG. 6, a flowchart representing an exemplary embodiment of a method 200 of operating the work implement 42 for the work machine 20, the work implement 42 coupled to the main frame 32 of the work machine 20 and having the one or more components, is depicted. In the context of the exemplary work implement 42 of the work machine 20 depicted in FIG. 1, the one or more components may include the boom 44, the arm 46, and/or the tool 48.

The method 200 may commence with a step 202 of providing the work machine 20 into a working area, the working area or terrain of which may be defined by the ground surface 38, as depicted in FIG. 1. The method 200 may continue with a step 204 of automatically or manually controlling the work implement 42 of the work machine 20 based at least in part on at least one characteristic for at least one of the one or more components of the work implement 42. The at least one characteristic may include a position or orientation of at least one of the one or more components of the work implement 42, including a position or orientation of the boom 44 and the arm 46 with respect to the at least one linkage joint, such as the linkage joint 106 or the linkage joint 105. In optional embodiments of the method 200, the step 204 of the method 200 may further include generating a display of the at least one characteristic for the one or more components, the display of which may be accessible or available by and through the display 118 of the controller 112.

The controller 112, which is functionally linked to at least one sensor of the sensor system 104, may be operable between a calibration mode associated with a step 206 and an operation mode associated with a step 208. In optional embodiments of the present disclosure, the calibration mode and the operation mode may be performed by a user-initiated selection or event by and through the controller 112; alternatively, the calibration mode and the operation mode may be performed by an automatic, non-manual event, in which the calibration mode and the operation mode may be preprogrammed into the controller 112 prior to operating the work machine 20 into the working area defined by the ground surface 38.

Referring to FIG. 6, the step 206 of the method 200 associated with the calibration mode may proceed by calibrating a position of at least one of the one or more components of the work implement 42, including the boom 44 or the arm 46. The method 200 may continue with a step 210 of associating at least one sensor of the sensor system 104 with at least one of the one or more components of the work implement 42, such that the at least one of the one or components of the work implement 42 correspond to the at least one linkage joint, including the linkage joint 105 and the linkage joint 106, or in optional embodiments, the linkage joint 108 and the linkage joint 110. The method 200 may continue with a step 212 of rotating the at least one of the one or more components of the work implement 42 about the axis defined by the at least one linkage joint, including the linkage joint 105 and the linkage joint 106, or in optional embodiments, the linkage joint 108 and the linkage joint 110. In the step 212, the at least one of the one or more components of the work implement 42 may be rotated about the axis defined by the at least one linkage joint into one or more poses 300, exemplary embodiments of which are set forth in FIGS. 7A-7D. As previously stated, the "linkage motion" may constitute a movement of the work implement 42 in the direction of the x-z coordinates, including an extension and/or contraction of the boom 44 and/or the arm 46. "Linkage motion" may also constitute a rotation of the one or more components about an axis defined by any one of the linkage joint 105, the linkage joint 106, the linkage joint 108, or the linkage joint 110, or any combination thereof. The "linkage motion" may constitute a rotation about an axis orthogonal to a plane defined by x-z space in the defined coordinate system, such that the "linkage motion" is generally aligned along a y-axis of the defined coordinate system.

Referring to FIG. 6, the method 200 may continue with a step 213 of performing at least one revolution of the work implement 42 about the pivot axis 36 with respect to the undercarriage 22 for each of the one or more poses 300, as illustratively conveyed in FIGS. 7A-7D. As previously stated, the pivot axis 36 may be generally orthogonal to the main frame 32 of the work machine 20. Otherwise stated, the pivot axis 36 may be substantially vertical when the ground surface 38 is engaged by the ground engaging units 24 is substantially horizontal. In other exemplary aspects of the method 200, the step 212 may proceed by rotating the at least one of the one or more components of the work implement 42 about the axis defined by the corresponding at least one linkage joint into at least two of the one or more poses 300, including, by way of example, any one of least a first pose 302, a second pose 304, a third pose 306, and a fourth pose 308, and combinations thereof, as illustratively conveyed in FIGS. 7A-7D. In further exemplary aspects of the method 200, the step 212 may proceed by rotating the at least one of the one or more components of the work implement 42 about the axis defined by the at least one linkage joint into at most two of the one or more poses 300, including, by way of example, any one of at least the first pose 302, the second pose 304, the third pose 306, and the fourth pose 308, and combinations thereof, as illustratively conveyed in FIGS. 7A-7D. For each of the one or more poses 300, the step 213 may proceed by performing at least two of the at least one revolution of the work implement 42 about the pivot axis 36 for each of the one or more poses 300, such as the first pose 302, the second pose 304, the third pose 306, or the fourth pose 308, and combinations thereof. In further exemplary aspects of the method 200, for each of the one or more poses 300, the step 213 may proceed by performing at least two of the at least one revolution of the work implement 42 about the pivot axis 36 for the at most two of the one or more poses 300, including at least one of the first pose 302, the second pose 304, the third pose 306, or the fourth pose, and combinations thereof. In other exemplary embodiments of the method 200, the step 213 may proceed by performing at least two of the at least one revolution of the work implement 42 about the pivot axis 36 for each of the one or more poses 300. In further exemplary embodiments of the method 200, the step 213 may proceed by performing a first of the at least one revolution of the work implement 42 about the pivot axis 36 at a rate of around one revolution per minute (RPM) or less. Optionally, the step 213 may further proceed by performing a second or more of the at least one revolution of the work implement 42 about the pivot axis 36 a rate greater than around one revolution per minute (RPM).

In accordance with the step 212 and the step 213, and in optional embodiments of the work implement 42 of the work machine 20, the work implement 42 may include a first of the one or more components having a first end coupled to the main frame 32 of the work machine 20 at a first of the at least one linkage joint, and a second of the one or more components may be coupled to a second end of the first of the one or more components at a second of the at least one linkage joint. In the context of the disclosure herein, the first of the one more components may constitute the boom 44 coupled to the main frame 32 at the linkage joint 105, and the second of the one or components may constitute the arm 46 coupled to the boom 44 at the linkage joint 106. The boom 44 may be rotated about the axis defined by corresponding the least one linkage joint, such as the linkage joint 105. Further, the arm 46 may be rotated about the axis defined by the corresponding at least one linkage joint, such as the linkage joint 106. The boom 44 and the arm 46 may be rotated about the axis defined by the at least one linkage joint, including the linkage joint 105 and the linkage joint 106, respectively, into the one or more poses 300. For each of the one or more poses 300 achieved by rotating the boom 44 and/or the arm 46 about the axis defined by the at least one linkage joint, at least one revolution of the work implement 42 about the pivot axis 36 may be performed. In optional embodiments, for each of the one or more poses 300 achieved by rotating the boom 44 and/or the arm 46 about the axis defined by the at least one linkage joint, including the linkage joint 105 and the linkage joint 106, respectively, two or more of the at least one revolution of the work implement 42 about the pivot axis 36 may be performed.

Figure 7A:
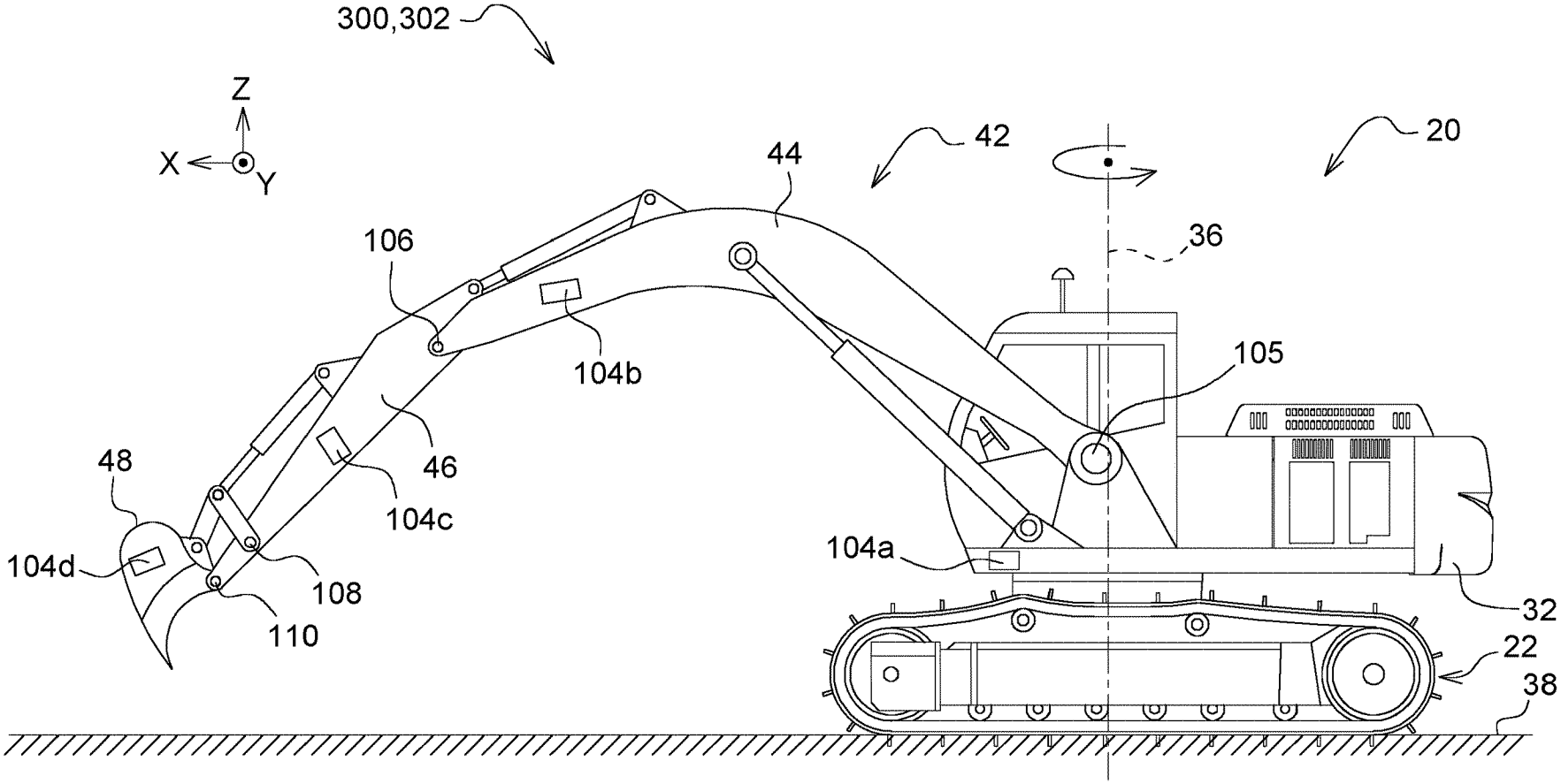
FIGS. 7A-7D are side views representing an excavator as an exemplary work machine where a boom assembly is rotated into one or more poses, according to an embodiment of the present disclosure.
Figure 7B:
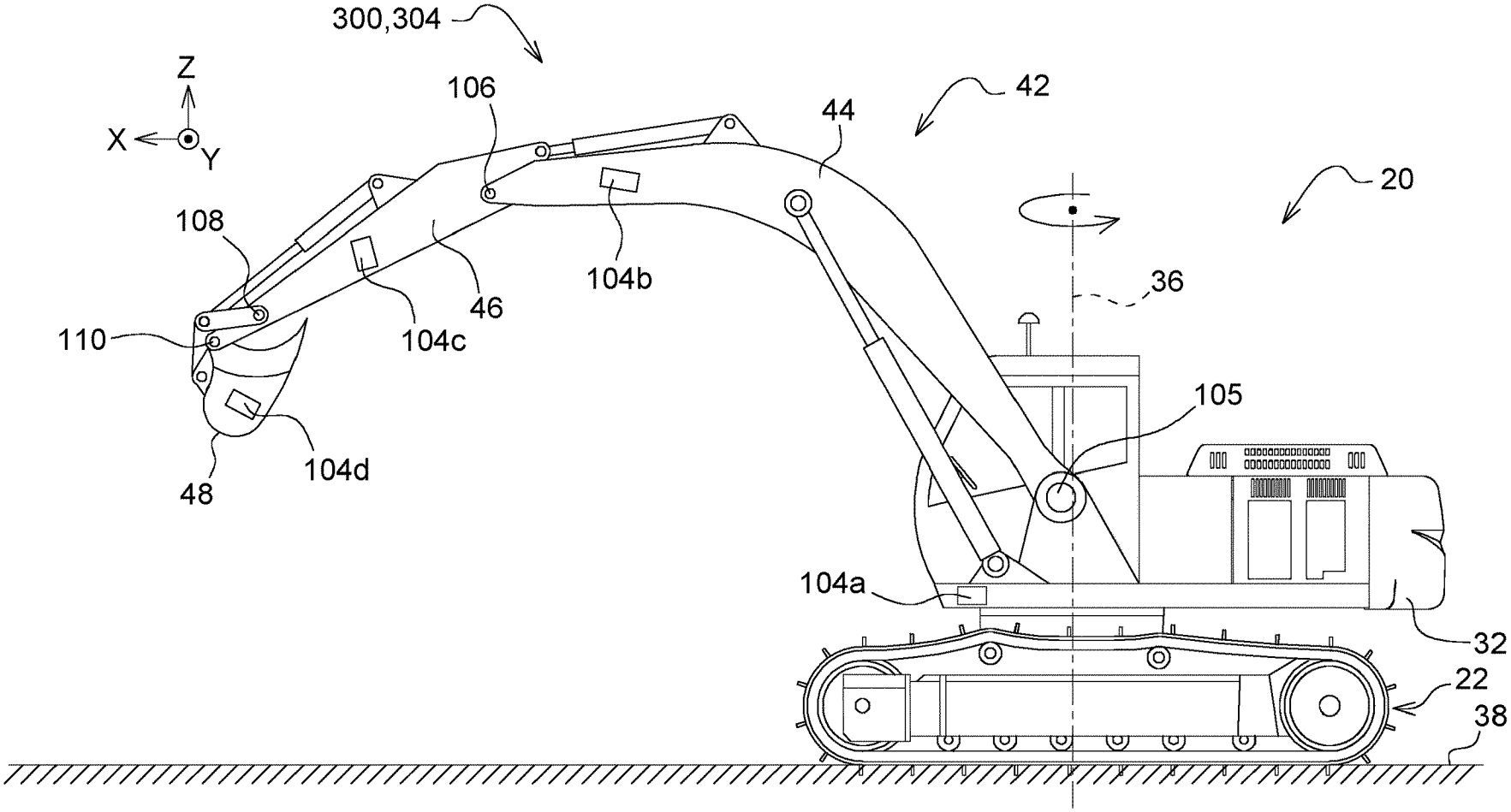

Referring to FIGS. 7A-7D, exemplary embodiments of the step 212 and the step 213 are visually depicted, such that the one or more components of the work implement 42 are rotated about the axis defined by the at least one linkage joint into the one or more poses 300, and the work implement 42 revolves about the pivot axis 36 with respect to the undercarriage 22. In exemplary aspects of the method 200, the one or more components of the work implement 42 may be rotated about the axis defined by the at least one linkage joint into at most two of the one or more poses 300, wherein the at most two of the one or more poses 300 may be any one of at least the first pose 302, the second pose 304, the third pose 306, or the fourth pose 308, and combinations thereof. For the purpose of the disclosure herein, the one or more poses 300 depicted in FIGS. 7A-7D are not intended to be limiting; rather, the one or more poses 300 depicted in 300 are representative examples of the one or more poses 300 that may be achieved by rotating the work implement 42 about the axis defined by the at least one linkage joint. Referring to FIG. 7A, the first pose 302 of the one or more poses 300 is depicted. The arm 46 may be rotated about the axis defined by the corresponding at least one linkage joint—the linkage joint 106—such that the arm 46 is fully extended in the x-z space, wherein the arm 46 achieves a maximum rotation about the linkage joint 106. The boom 44 may be rotated about the axis defined by the corresponding at least one linkage joint—the linkage joint 105—such that the boom 44 may be lowered in the direction of the ground surface 38 with the working tool 48 proximate to, but not in contact with, the ground surface 38. In optional embodiments of the first pose 302, the working tool 48, or the bucket 48, may be in a "full dump" position, such that the working tool 48 is rotated about the axis defined by the corresponding at least one linkage joint—the linkage joint 110—in the direction away from the main frame 32 of the work machine 20. Referring to FIG. 7B, the second pose 304 of the one or more poses 300 is depicted. The arm 46 may be rotated about the axis defined by the corresponding at least one linkage joint—the linkage joint 106—such that the arm 46 is fully extended in the x-z space, wherein the arm 46 achieves a maximum rotation about the linkage joint 106. The boom 44 may be rotated about the axis defined by the corresponding at least one linkage joint—the linkage joint 105—such that the boom 44 may be moved to a "middle height" position, which is a position between a maximum and a minimum rotation of the boom 44 about the linkage joint 105. In optional embodiments of the second pose 304, the working tool 48 may be in a "full curl" position, such that the working tool 48 is rotated about the axis defined by the corresponding at least one linkage joint—the linkage joint 110—in the direction toward the main frame 32 of the work machine 20.

Figure 7C:
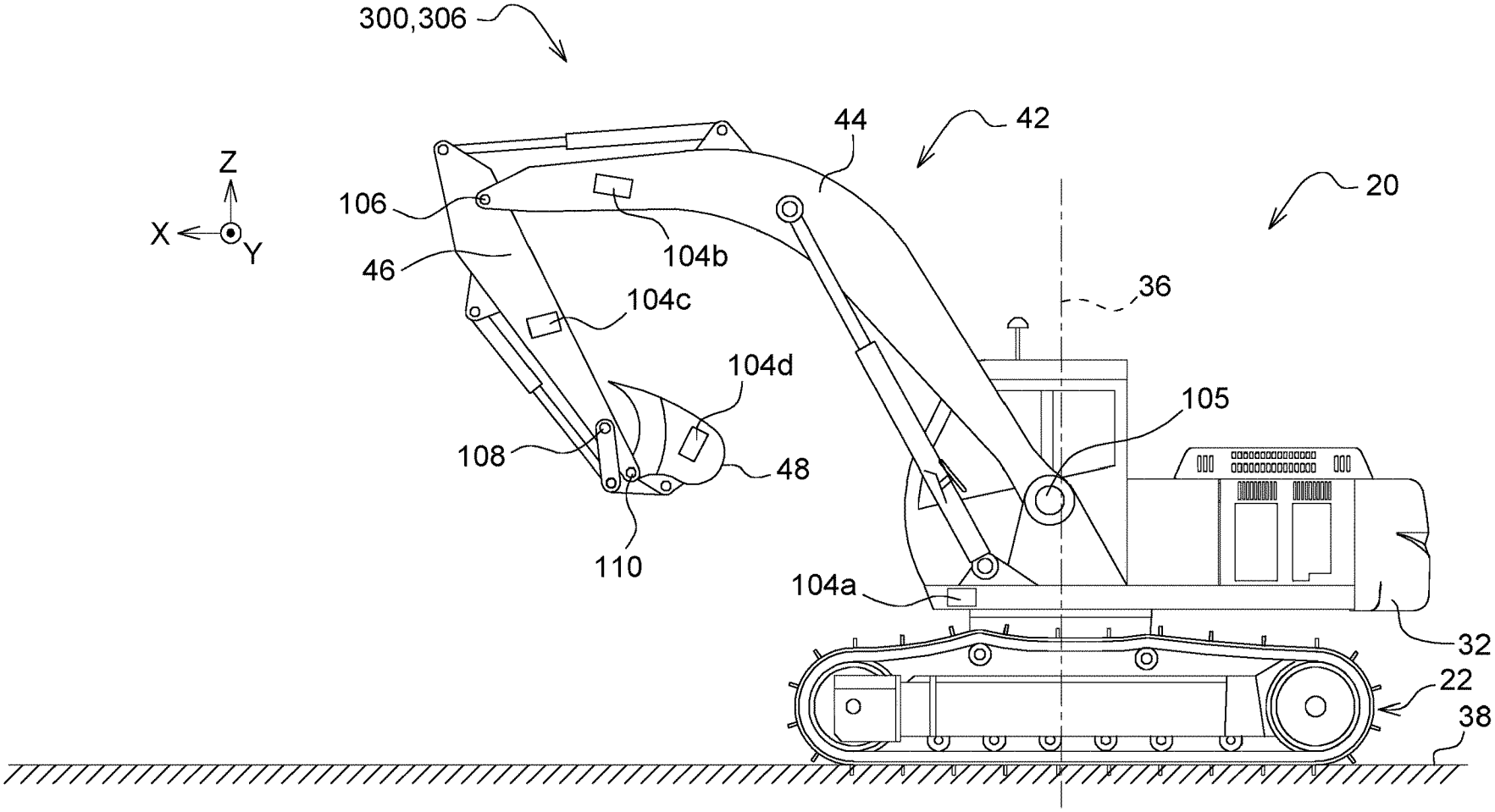
Figure 7D:
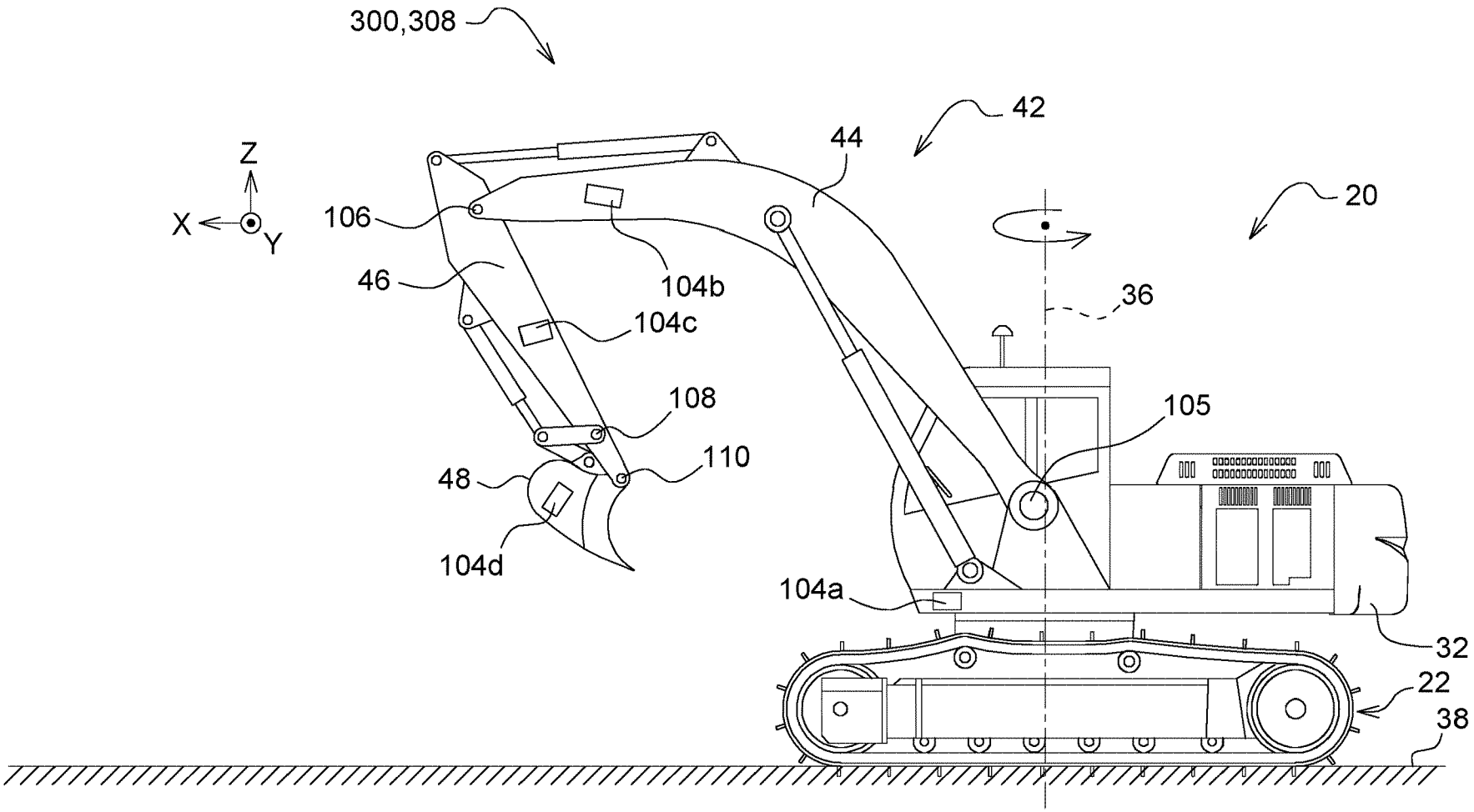

Referring to FIG. 7C, the third pose 306 of the one or more poses 300 is depicted. The arm 46 may be rotated about the axis defined by the corresponding at least one linkage joint—the linkage joint 106—such that the arm 46 is rotated around ninety degrees (90°) from its position in FIGS. 7A-7B in the direction of the main frame 32 of the work machine 20. This rotation of the arm 46 may otherwise be referred to as a contraction of the arm 46 in the x-z space. The boom 44 may be rotated about the axis defined by the corresponding at least one linkage joint—the linkage joint 105—such that the boom 44 may be moved to a "middle height" position, which is a position between a maximum and a minimum rotation of the boom 44 about the linkage joint 105. In optional embodiments of the third pose 306, the working tool 48 may be in a "full curl" position, such that the working tool 48 is rotated about the axis defined by the corresponding at least one linkage joint—the linkage joint 110—in the direction toward the main frame 32 of the work machine 20. Referring to FIG. 7D, the fourth pose 308 of the one or more poses 300 is depicted. The arm 46 may be rotated about the axis defined by the corresponding at least one linkage joint—the linkage joint 106—such that the arm 46 is rotated around ninety degrees (90°) from its position in FIGS. 7A-7B in the direction of the main frame 32 of the work machine 20. This rotation of the arm 46 may otherwise be referred to as a contraction of the arm 46 in the x-z space. The boom 44 may be rotated about the axis defined by the corresponding at least one linkage joint—the linkage joint 105—such that the boom 44 may be moved to a "maximum height" position, wherein the boom 44 achieves a maximum rotation about the linkage joint 105. In optional embodiments of the fourth pose 308 of the one or more poses 300, the working tool 48, or the bucket 48, may be in a "full dump" position, such that the working tool 48 is rotated about the axis defined by the corresponding at least one linkage joint—the linkage joint 110—in the direction away from the main frame 32 of the work machine 20.

For each of the one or more poses 300, including the first pose 302, the second pose 304, the third pose 306, and the fourth pose 308, as illustratively conveyed in FIGS. 7A-7B, the work implement 42 may revolve about the pivot axis 36 with respect to the undercarriage 22. In exemplary embodiments of the step 213, the work implement 42 may perform a first revolution about the pivot axis 36 at a rate of around one revolution per minute (RPM) or less. In further exemplary aspects of the step 213, the work implement 42 may perform a second or more revolution about the pivot axis 36 at a rate greater than around one revolution per minute (RPM). In optional embodiments of the step 213, intermittent pauses or rests may be inserted between successive revolutions of the work implement 42 about the pivot axis 36. The intermittent pauses or rests may range from around fifteen (15) seconds to around sixty (60) seconds.

Referring to FIG. 6, the method 200 may continue with a step 214 of receiving output signals from the at least one sensor of the sensor system 104, such as the sensor 104*a*, the sensor 104*b*, the sensor 104*c*, the sensor 104*d*, and/or the sensor 104*e*. The sensor system 104 may be a system of IMUs, each of which may include the accelerometer, the gyroscope, and/or the magnetometer, and each IMU having the body frame. The output signals may include sense elements, and in optional embodiments, the sense elements may include a plurality of angular velocity measurements measured by the gyroscope of the IMU in the sensor system 104, the angular velocity measurements ascertained by the swing motion of the work implement 42 or the linkage motion of the one or more components of the work implement 42. The sense elements from the received output signals may be received by the controller 112, as depicted in FIG. 2, which is functionally linked to the sensor system 104.

In optional embodiments of the step 214 and prior to a step 215 of tracking at least one characteristic based upon a least a portion of the sense elements, the method 200 may incorporate an algorithm that merges measurements received by the sensor system 104 to produce a desired output in the work implement 42 of the self-propelled vehicle 20. The algorithm may include or otherwise proceed with an initialization routine, which initializes bias due with respect to measurements received by the gyroscope in the sensor system 104. Estimated bias due to the gyroscope may be subtracted from the measured gyroscopic data received by the IMUs, enabling the calculation of angular velocity and angular acceleration. The algorithm may further include the selection of a filtering algorithm with an applicable selection of a gain value, based upon measured noise due from a particular working area, the working area or terrain of which may be defined by the ground surface 38. A filter may be necessary to process high-frequency measurements, such as those received by gyroscope in the IMUs. Moreover, there may be various filter methods that may be used in connection with the measurements received by the IMUs, including, for example, a Kalman Filter (KF) and/or a Complementary Filter (CF).

Referring to FIG. 6, the method 200 may continue with the step 215 of tracking the at least one characteristic based upon at least a portion of the sense elements from the received output signals for the at least one of the one or more components of the work implement 42. The sense elements from the received output signals may be received by the controller 112, as depicted in FIG. 2, which is functionally linked to the sensor system 104, and the controller 112 may be configured to track the at least one characteristic. The step 215 may employ linkage kinematics and rigid body motion to determine an angular velocity or angular acceleration, the acceleration of which may yield an angle or orientation of at least one of the one or more components of the work implement 42.

In other aspects of the method 200, the step 215 may proceed by tracking the at least one characteristic by identifying maximum angular velocity or angular acceleration measurements and minimum angular velocity measurements based at least in part of the sense elements comprising (at least in part) the plurality of angular velocity measurements. The maximum angular velocity measurements (otherwise known as a "peak") and/or the minimum angular velocity measurements (otherwise known as a "valley") may be ascertained by initiating a revolution of the work implement 42 at varying speed, where a first of the at least one revolution of the work implement 42 about the pivot axis 36 with respect to the undercarriage 22 may be performed at a rate around 1 revolution per minute (RPM) or less, and a second or more of the at least one revolution may be performed at a rate around 1 revolution per minute (RPM) or greater, including greater than 10 revolution per minute (RPM). The at least one revolution corresponding to the one or more poses 300 of the one or more components of the work implement 42 are illustratively conveyed in FIGS. 7A-7D, and elaborated upon further upon in conjunction with the step 212 and the step 213 of the method 200 as disclosed in FIG. 6. For example, in tracking the at least one characteristic of the one or more components of the work implement 42 so as to calibrate a position or orientation of the one or more components, the maximum angular velocity measurements and the minimum angular velocity measurements may be compared to ascertain a vector ρ, the vector ρ evidencing a position or orientation of the one or more components of the work implement 42. Calculation and comparison of the foregoing may be representatively conveyed in the following series of equations:

A_Rotate=A_Static−ρω^2

A_(Max,Fast)−A_(Max,Slow)=ρ(ω_Fast^2−ω_Slow^2)

A_(Min,Fast)−A_(Min,Slow)=ρ(ω_Fast^2−ω_Slow^2)

$$\rho - \frac{(A_{Max,Fast} - A_{Max,Slow})}{\omega_{Fast}^2 - \omega_{Slow}^2}$$

For the at least one revolution of the work implement 42, the vector ρ of the one or more components of the work implement 42 may not be determined or calculated along the pivot axis 36 with respect to the undercarriage 22.

In solving or ascertaining the vector ρ, the vector ρ may be positionally oriented in the direction of the at least one linkage joint, such that the vector ρ may extend from at least one of the sensor system 104 to the at least one linkage joint. For example, the vector ρ may extend from the sensor 104*b* to the linkage joint 106 and the vector ρ may extend from the sensor 104*c* to the linkage joint 106; alternatively, or in conjunction with the foregoing, the vector ρ may extend from the sensor 104*b* to the linkage joint 105. The vector ρ, measured from the sensor system 104, may be functionally used to translate the sense elements received from the sensor system 104 of IMUs into positions or orientations of the one or more components of the work implement 42. Calculation of the foregoing may be representatively conveyed in the equation below:

$$\begin{bmatrix} 1 & \mathrm{Cos}(\theta_{B1}) & \mathrm{Sin}(\theta_{B1}) \\ 1 & \mathrm{Cos}(\theta_{B2}) & \mathrm{Sin}(\theta_{B2}) \\ 1 & \mathrm{Cos}(\theta_{B3}) & \mathrm{Sin}(\theta_{B3}) \end{bmatrix} \begin{bmatrix} x_{BoomPivot}^{Frame} \\ x_{BoomPivot}^{Boom} \\ z_{BoomPivot}^{Boom} \end{bmatrix} = \begin{bmatrix} \|\rho_{B1}\| \\ \|\rho_{B2}\| \\ \|\rho_{B3}\| \end{bmatrix}$$

$$\begin{bmatrix} \mathrm{Cos}(\theta_{B1}) & \mathrm{Sin}(\theta_{B1}) & \mathrm{Cos}(\theta_{A1}) & \mathrm{Sin}(\theta_{A1}) \\ \mathrm{Cos}(\theta_{B2}) & \mathrm{Sin}(\theta_{B2}) & \mathrm{Cos}(\theta_{A2}) & \mathrm{Sin}(\theta_{A2}) \\ \mathrm{Cos}(\theta_{B3}) & \mathrm{Sin}(\theta_{B3}) & \mathrm{Cos}(\theta_{A3}) & \mathrm{Sin}(\theta_{A3}) \\ \mathrm{Cos}(\theta_{B4}) & \mathrm{Sin}(\theta_{B4}) & \mathrm{Cos}(\theta_{A4}) & \mathrm{Sin}(\theta_{A4}) \end{bmatrix} \begin{bmatrix} x_{ArmPivot}^{Boom} \\ z_{ArmPivot}^{Boom} \\ x_{ArmPivot}^{Arm} \\ z_{ArmPivot}^{Arm} \end{bmatrix} = \begin{bmatrix} \|\rho_{A1}\| - \|\rho_{B1}\| \\ \|\rho_{A2}\| - \|\rho_{B2}\| \\ \|\rho_{A3}\| - \|\rho_{B3}\| \\ \|\rho_{A4}\| - \|\rho_{B4}\| \end{bmatrix}$$

In the equation above, the vector ρ may constitute the magnitude of the position or orientation measured in the x-z plane with the subscripts of A (e.g., $A_1$-$A_4$) and B ($B_1$-$B_4$) associated with the one or more poses 300 corresponding to the arm 46 and the boom 44. Theta (θ) may be the angle measured relative to the swing motion of the work implement 42 about the pivot axis 36 with respect to the undercarriage 22. Using the variable p, the at least one characteristic, such as the position or orientation of the one or more components of the work implement 42 may be calculated, thereby calibrating for a misalignment of the sensor system 104 due to a variation in manufacturing of the sensor system 104 (and subsequent affixation of the sensor system 104 on the work implement 42) or dynamic working conditions.

Referring to FIG. 6, in exemplary aspects of the method 200, the step 208 of the method 200 associated with the operation mode may proceed by directing movement of the at least one of the one or more components of the work implement 42, including the boom 44 and the arm 46. The method 200 may continue with a step 220 of directing movement of the at least one of the one or more components of the work implement 42 based at least in part of the tracked at least one characteristic for the at least one of the one or more components of the work implement 42. In optional embodiments, the at least one characteristic may be an orientation or position of the at least one of the one or more components of the work implement 42 with respect to the corresponding at least one linkage joint. The orientation or position of the at least one of the one or more components of the work implement 42 may based be upon at least a portion of the plurality of angular velocity measurements, and in optional embodiments, may be based upon at least a portion of the plurality of angular velocity measurements where the maximum angular velocity measurements and the minimum angular velocity measurements were identified.

In the context of the disclosure for the step 204 of the method 200, movement of the one or more components of the work implement 42, including the boom 44, the arm 46, and/or the working tool 48, may be controlled or directed based at least in part on the tracked at least joint characteristic. The controller 112, which may be functionally linked to the sensor system 104, as illustrated in FIG. 2, may further be configured to automatically control movement of the one or more components of the work implement 42, or the boom assembly 42, of the work machine 20, or the excavator 20. The human operator may effectuate movement or direction of the one or more components of the work implement 42 by or through the user interface tool 116 of the user interface 114. By interacting with the user interface tool 116 of the user interface 114, the controller 112 may be configured to operate the machine implement control system 128 of the one or more components of the work implement 42 of the work machine 20. The controller 112 may, for example, generate control signals for controlling the operation of various actuators, such as hydraulic motors or hydraulic piston-cylinder units 41, 43, and 45, as depicted in FIG. 1. Alternatively, or in conjunction with the step 204, the method 200 may continue by generating a display of the tracked at least one characteristic for at least one of the one or more components of the work implement 42 of the work machine 20. The controller 112, which may be functionally linked to the sensor system 104, as illustrated in FIG. 2, may be configured to display the at least one characteristic for at least one of the one or more components of the work implement 42, including the boom 44, the arm 46, and/or the working tool 48. Specifically, the display 118 of the user interface tool 116 in the controller 112 may display, exhibit, or otherwise convey to the human operator the tracked at least one characteristic for at least one of the one or more components of the work implement 42, such as the boom 44, the arm 46, and/or the working tool 48.

Referring to FIG. 6, and as previously stated, the controller 112, which is functionally linked to at least one sensor of the sensor system 104, including the sensor 104*a*, the sensor 104*b*, the sensor 104*c*, the sensor 104*d*, and the sensor 104*e*, may be operable between the calibration mode associated with the step 206 and the operation mode associated with the step 208. And further, as previously stated, the calibration mode and the operation mode may be performed by the user-initiated selection or event; alternatively, the calibration mode and the operation mode may be performed by an automatic, non-manual event, in which the calibration mode and the operation mode may be pre-programmed into the controller 112 prior to operating the work machine 20 into the working area defined by the ground surface 38. Importantly, the step 204 of controlling the work implement 42 based at least on one characteristic, including the position or orientation of the one or more components of the work implement 42 need not proceed to the calibration mode; thus, directing movement of the one or more components of the work implement 42 into the swing motion or the linkage motion does not hinge upon, nor depend upon, the initiation or configuration of the calibration mode associated with the step 206.

Referring to FIGS. 8A-8F, various graphs depict a representative example of the method 200 carried out in steps enumerated in the disclosure herein; specifically, the graphs of FIGS. 8A-8F illustrate a collection and receipt of sense elements from output signals, including angular velocity measurements and angular acceleration measurements, received by the sensor system 104 when undertaking the swing motion and the linkage motion of the boom 44, the boom 44 serving as an exemplary one of the one or more components of the work implement 42. In summary, and without limiting the foregoing, FIGS. 8A-8F convey a correction or calibration of the mounting misalignment of the sensor system 104.

Figure 8A:
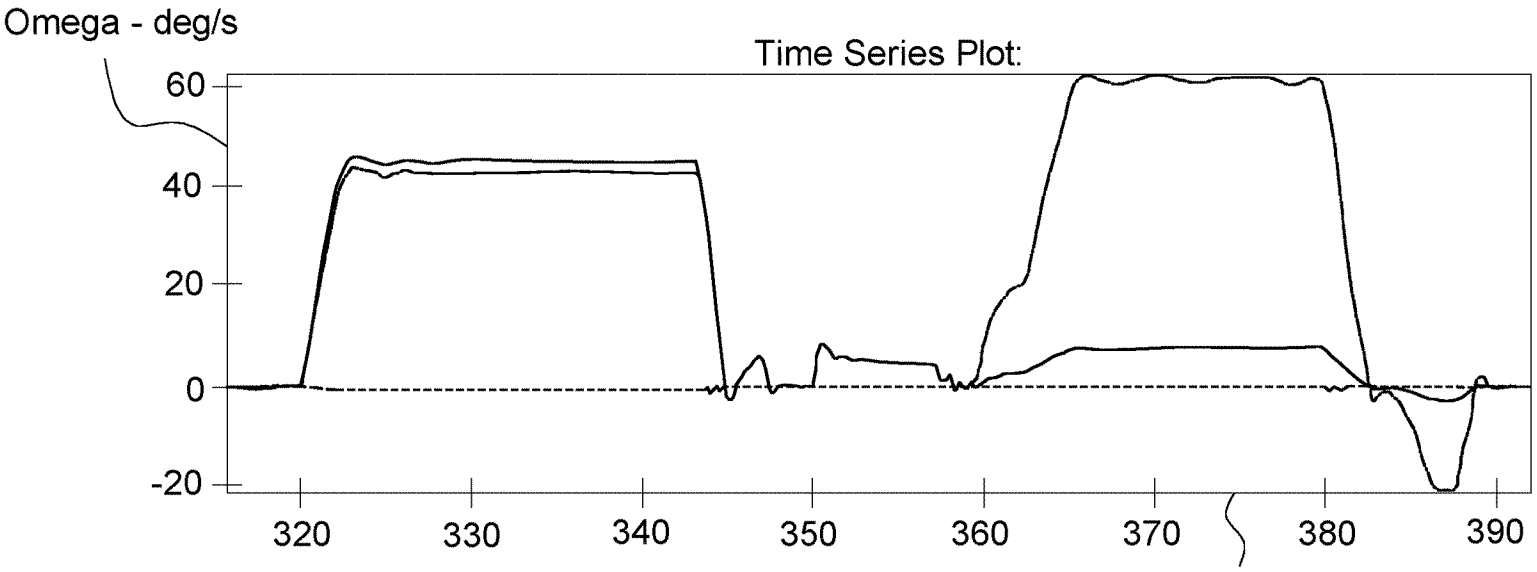
FIGS. 8A-8F are graphs conveying an orientation of a boom as an exemplary one of one or more components of an implement on a work machine according to an embodiment of the present disclosure.
Figure 8B:
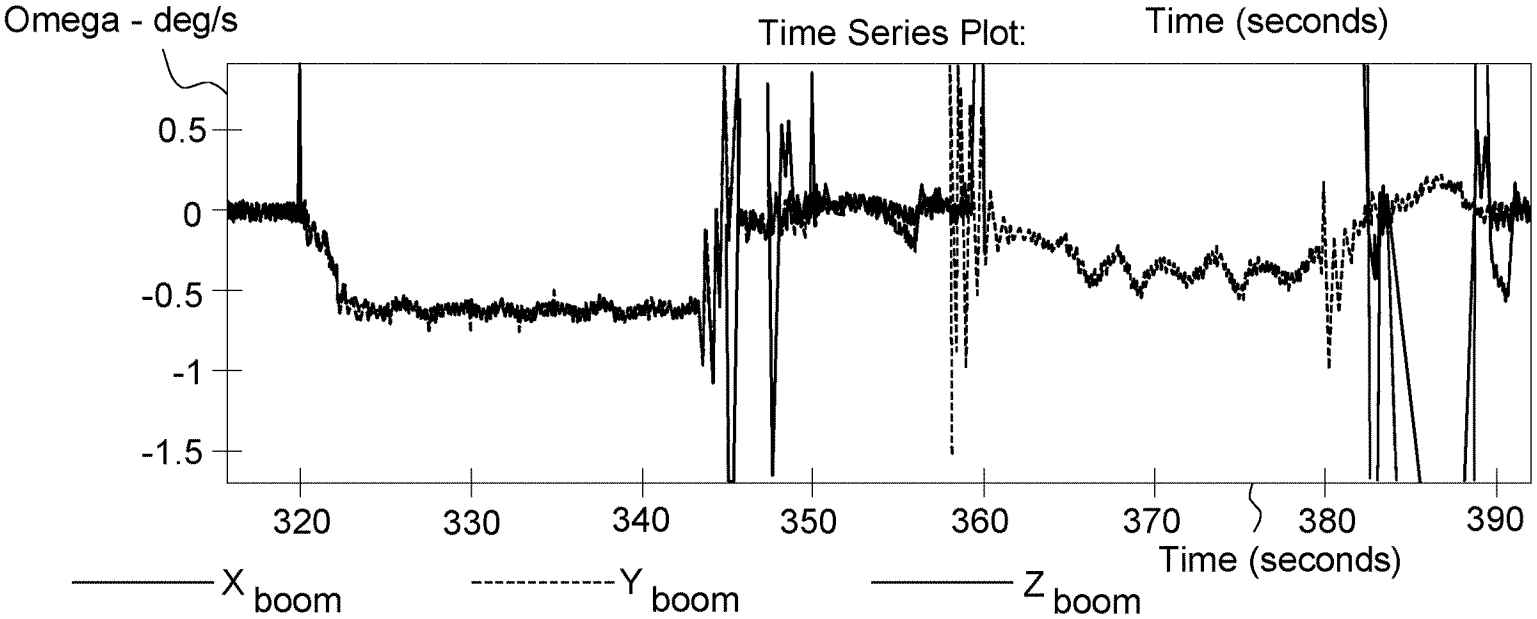
Figure 8C:
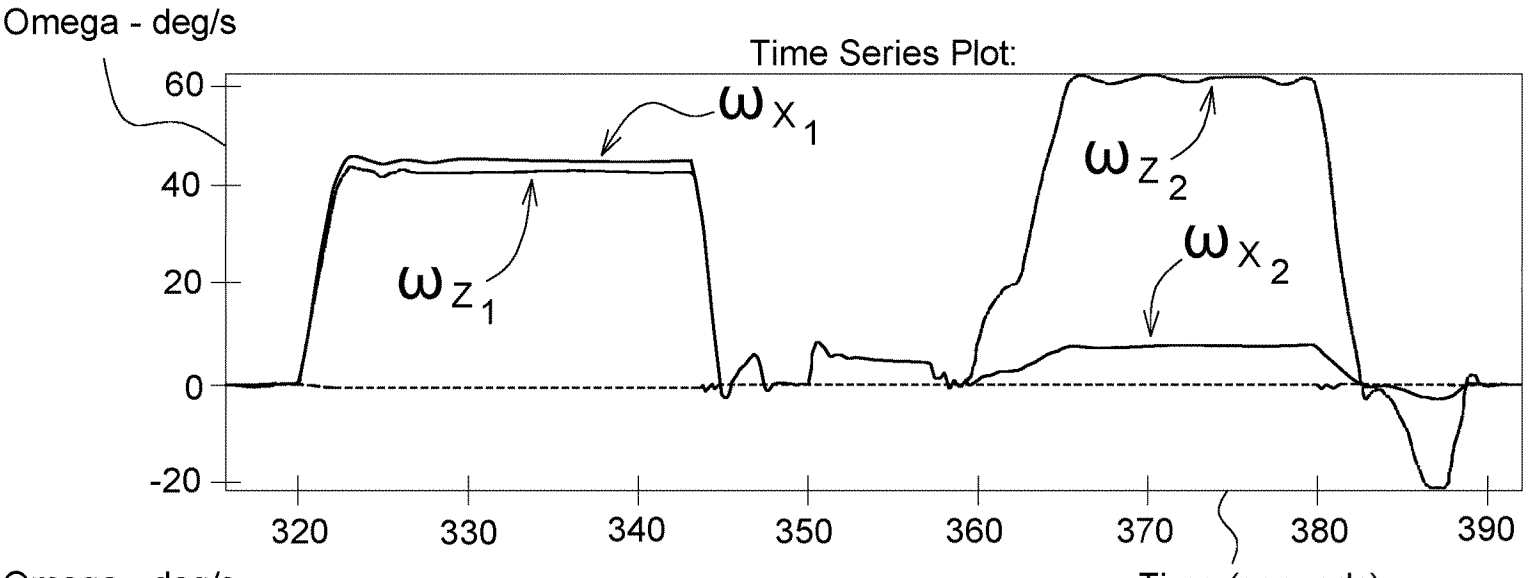
Figure 8D:
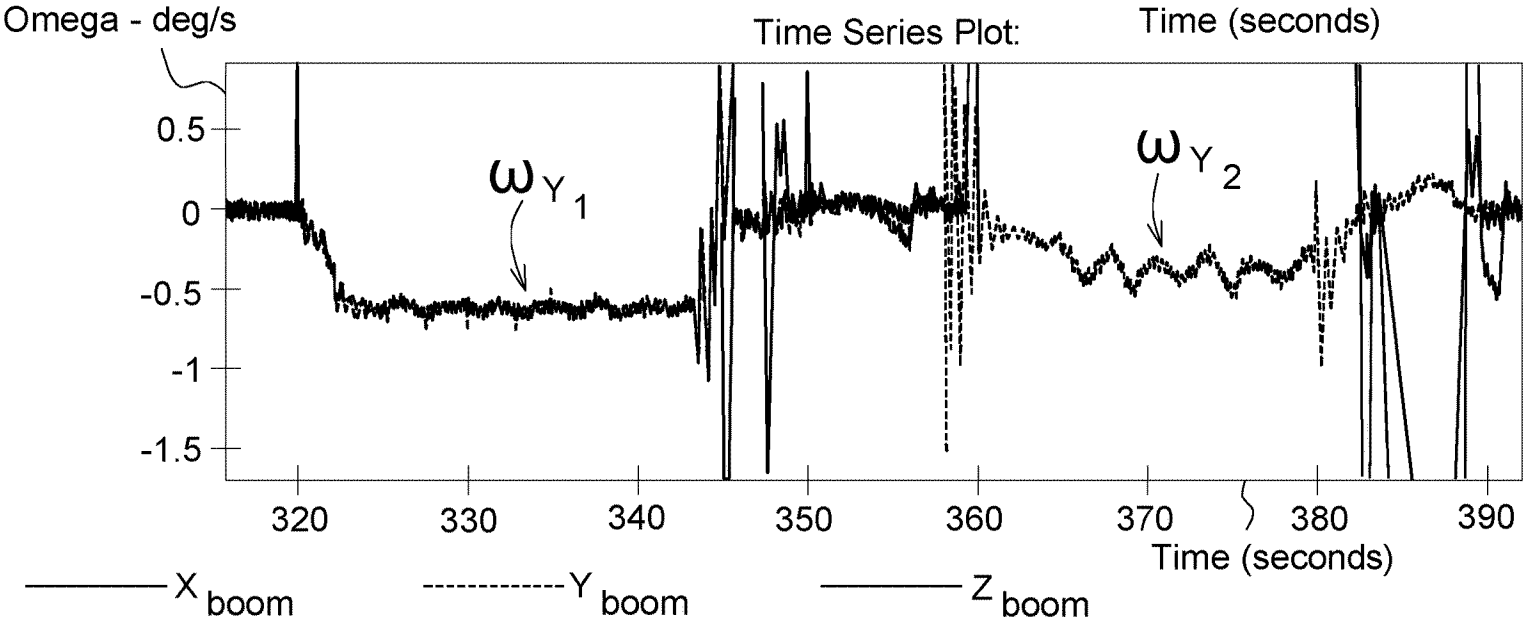

Referring to FIG. 8A-8B, two positions or orientations of the boom 44 are tested to ascertain a change in angular velocity or angular acceleration of the boom 44, wherein the two positions or orientations are −46.6 degrees and −7.2 degrees with respect to the corresponding at least one linkage joint, where the boom 44 is rotated about the axis defined by the corresponding at least one linkage joint. Where the boom 44, as part of the work implement 42, is revolved about the pivot axis 36 with respect to the undercarriage 22, otherwise constituting the "swing motion," measurements of angular velocity about the y-axis (or a pitch) by −0.6 degrees per second and −0.4 degrees per second were collected by the sensor system 104. The excitation about the y-axis evinces a confusion or a misconstruction of the linkage motion of the one or more components of the work implement 42 with the swing motion of the work implement 42 about the pivot axis 36. Referring to FIGS. 8C-8D, using small angle approximation and stacking results from angular velocity measurements, a model of linear best-fit may be performed, the equations of which are representatively set forth as follows:

$$\begin{bmatrix} -\omega_X & \omega_Z \end{bmatrix} \begin{bmatrix} \theta_{Yaw} \\ \theta_{Roll} \end{bmatrix} = \omega_Y$$

$$\begin{bmatrix} -\omega_{X_1} & \omega_{Z_1} \\ \vdots & \vdots \\ -\omega_{X_N} & \omega_{Z_N} \end{bmatrix} \begin{bmatrix} \theta_{Yaw} \\ \theta_{Roll} \end{bmatrix} = \begin{bmatrix} \omega_{Y_1} \\ \vdots \\ \omega_{Z_N} \end{bmatrix}$$

$$(A^T A)^{-1} A^T B = \begin{bmatrix} \theta_{Yaw} \\ \theta_{Roll} \end{bmatrix}$$

In the equation above, the variable co may constitute the angular velocity about the x-axis, y-axis, and the z-axis, in accordance with the reference frame as set forth in FIGS. 1, 3-4, and 7A-7D, with theta (θ) being the angle measured relative to the yaw (rotation about the z-axis) and the roll (rotation about the x-axis) associated with a motion of the boom 44.

Figure 8E:
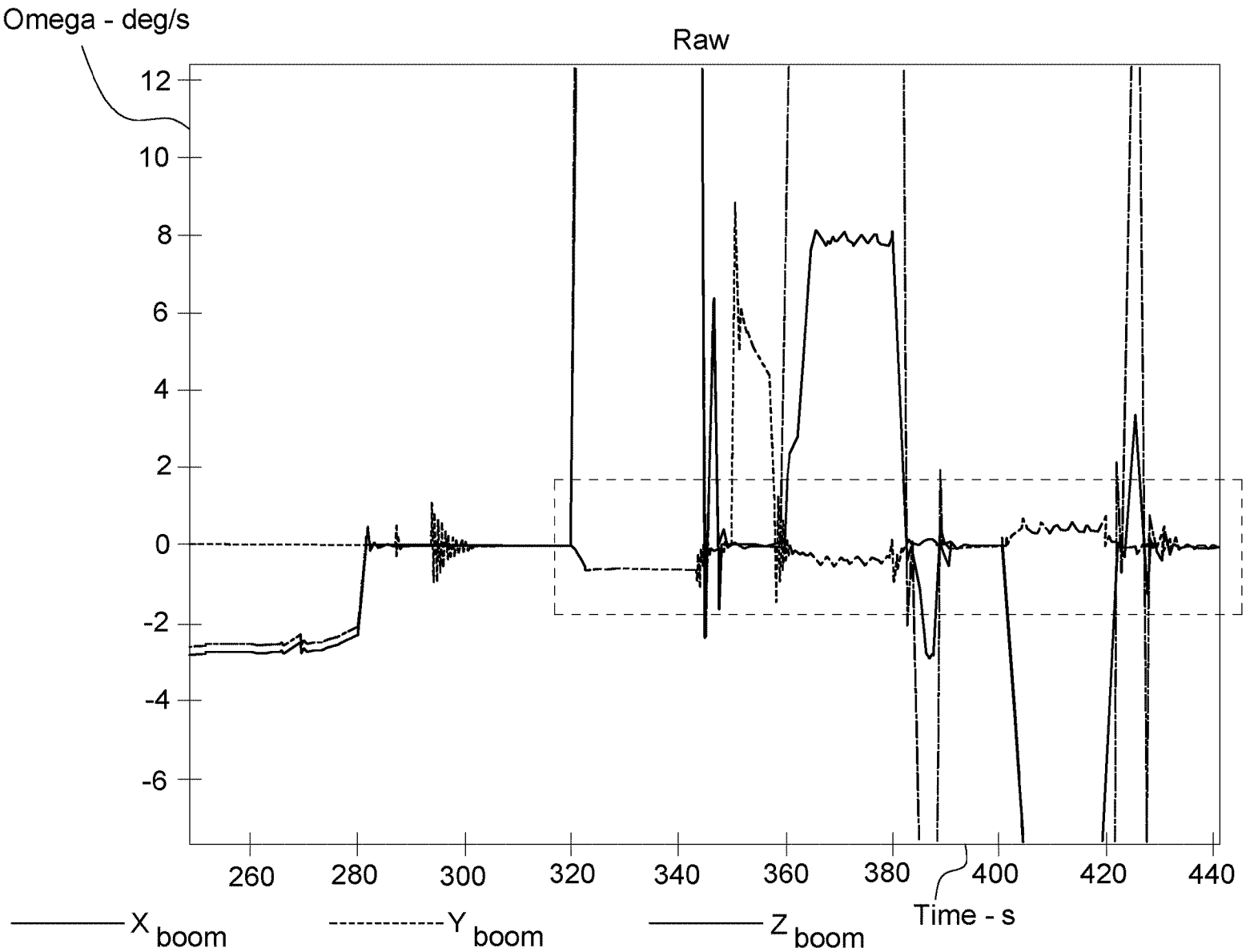
Figure 8F:
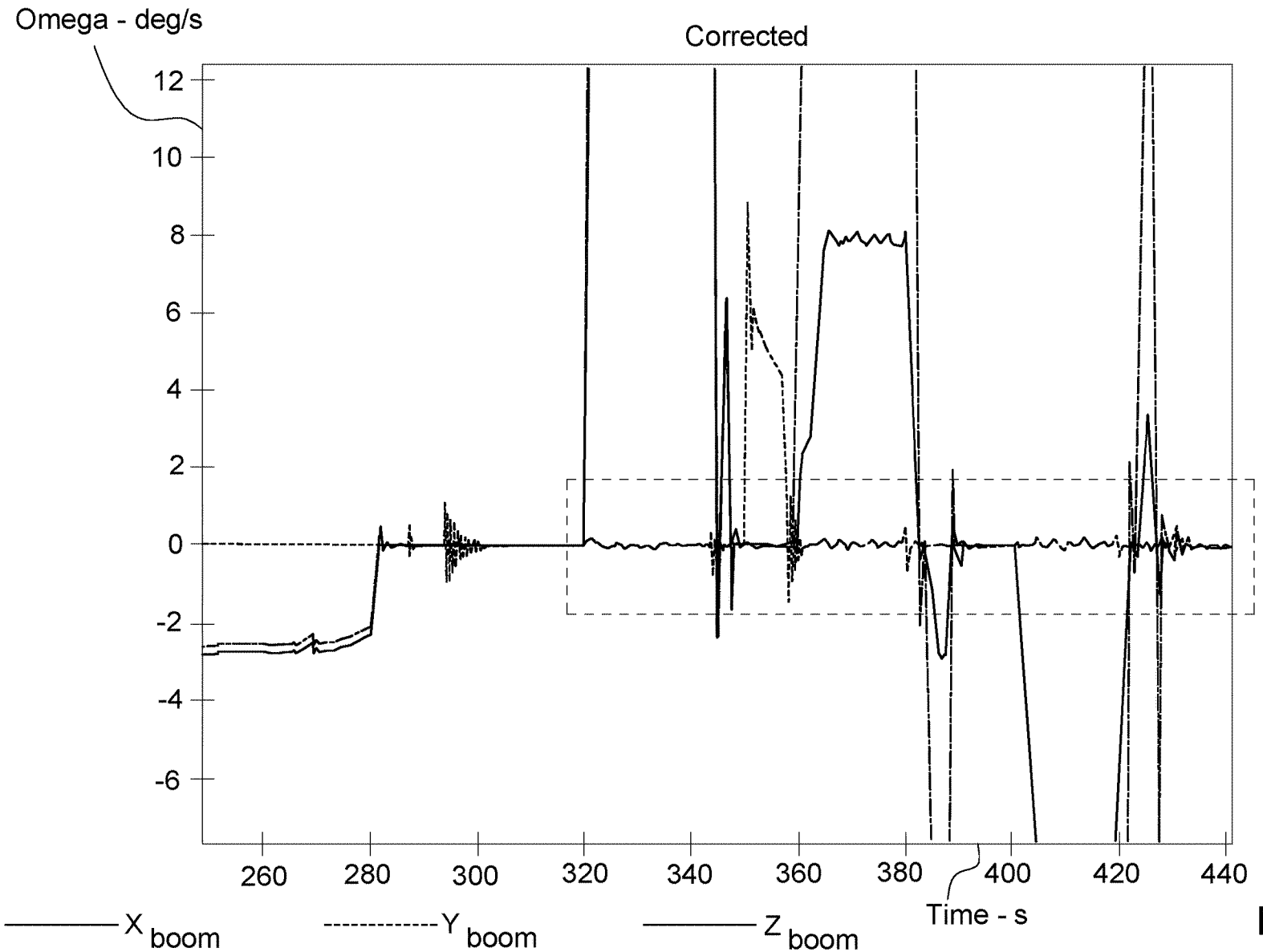

Referring to FIGS. 8E-8F, a difference between a calibrated (or corrected) and non-calibrated (raw) sensor system 104 on the boom 44 is illustratively conveyed. As previously set forth in FIGS. 8A-8B, where the boom 44, as part of the work implement 42, is revolved about the pivot axis 36 with respect to the undercarriage 22, measurements of angular velocity about the y-axis (or a pitch) by −0.6 degrees per second and −0.4 degrees per second. The excitation about the y-axis evinces a confusion or a misconstruction of the linkage motion of the one or more components of the work implement 42 with the swing motion of the work implement 42 about the pivot axis 36. By calibrating for the position or orientation for at least one of the one or more components of the work implement 42, including the boom 44, the swing motion of the work implement 42 may no longer excite the y-axis of the gyroscope of the sensor system 104. Thus, in undertaking the linkage motion and/or the swing motion, tracking the position or orientation of the one or more components of the work implement 42 may not influenced or biased by excitation of the y-axis in the gyroscope of the IMU in the sensor system 104. The correction of y-axis excitation of the gyroscope of the sensor system 104 when controlling movement of the least one of the one or more components of the work implement 42 may identify and detect the manner in which the IMUs may have been misaligned either due to manufacturing variations in the construction of the work implement 42 or due to subjecting the work machine 20 to dynamic conditions. By identifying and detecting the misalignment of the sensor system 104, fusion of the sense elements, including angular velocity measurements, will yield or enable a prescribed or directed movement of the one or more components of the work implement 42.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment, "in optional embodiment(s)," or the like do not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments of whether these features, elements, and/or states are included or are to be performed in any particular embodiment.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

The previous detailed description has been provided for the purposes of illustration and description. Thus, although there have been described particular embodiments of a new and useful invention, it is not intended that such references be construed as limitations upon the scope of this disclosure. Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims.

What is claimed is:

1. A computer-implemented method of operating an implement for a work machine, the implement coupled to a frame of the work machine and having one or more components, the method comprising:

a) calibrating a position of at least one of the one or more components of the implement by:

associating at least one sensor with the at least one of the one or more components of the implement, the at least one of the one or more components of the implement corresponding to at least one linkage joint;

rotating the at least one of the one or more components of the implement about an axis defined by the corresponding at least one linkage joint into one or more poses;

for each of the one or more poses, performing at least one revolution of the implement about an axis substantially orthogonal to the frame of the work machine, wherein the axis is substantially orthogonal to a ground surface engaged by ground engaging units supporting the frame of the work machine;

receiving output signals from the at least one sensor, said output signals comprising sense elements; and tracking at least one characteristic based upon at least a portion of the sense elements from the received output signals for the at least one of the one or more components of the implement; and b) directing movement of the at least one of the one or more components of the implement based at least in part on the tracked at least one characteristic for the at least one of the one or more components of the implement.

2. The method of claim 1, further comprising:

enabling a user-initiated selection of a calibration mode corresponding to the step a).

3. The method of claim 1, further comprising:

enabling a user-initiated selection of an operation mode corresponding to the step b).

4. The method of claim 1, further comprising:

enabling a user-initiated selection of a calibration mode corresponding to the step a) and an operation mode corresponding to the step b).

5. The method of claim 1, wherein:

the at least one characteristic comprises an orientation of the at least one of the one or more components of the implement with respect to the corresponding at least one linkage joint.

6. The method of claim 5, wherein:

the step b) further comprises directing movement of the at least one of the one or more components of the implement based at least in part on the orientation of the at least one of the one or more components of the implement with respect to the corresponding at least one linkage joint.

7. The method of claim 1, wherein:

the sense elements comprise a plurality of angular velocity measurements; and the step a) further comprises tracking the at least one characteristic based upon at least a portion of the plurality of angular velocity measurements for the at least one of the one or more components of the implement.

8. The method of claim 1, wherein:

the sense elements comprise a plurality of angular velocity measurements; and the step a) further comprises tracking the at least one characteristic by identifying maximum angular velocity measurements and minimum angular velocity measurements based at least in part on the plurality of angular velocity measurements for the at least one of the one or more components of the implement.

9. The method of claim 1, wherein:

the step a) further comprises for each of the one or more poses, performing at least two of the at least one revolution of the implement about the axis generally orthogonal to the frame of the work machine.

10. The method of claim 1, wherein:

the step a) further comprises performing a first of the at least one revolution of the implement about the axis generally orthogonal to the frame at a rate of around one revolution per minute (RPM) or less, and performing a second or more of the at least one revolution of the implement about the axis generally orthogonal to the frame at a rate greater than around one revolution per minute (RPM).

11. The method of claim 1, wherein:

the implement comprises a first of the one or more components having a first end coupled to the frame of the work machine at a first of the at least one linkage joint, and a second of the one or more components coupled to a second end of the first of the one or more components at a second of the at least one linkage joint.

12. The method of claim 11, wherein the step a) further comprises:

rotating the first of the one or more components about an axis defined by the first of the at least one linkage joint into a first of the one or more poses; and for the first of the one or more poses, performing at least one revolution of the implement about the axis generally orthogonal to the frame of the work machine.

13. The method of claim 11, wherein the step a) further comprises:

rotating the first of the one or more components about an axis defined by the first of the at least linkage joint into a first of the one or more poses; and rotating the second of the one or more components about an axis defined by the second of the at least one linkage joint into a second of the one or more poses.

14. The method of claim of 13, wherein:

the step a) further comprises for the first and second of the one or more poses, performing at least one revolution of the implement about the axis generally orthogonal to the frame of the work machine.

15. A work machine comprising:

an implement configured for working terrain, the implement coupled to a frame of the work machine, and the implement having one or more components, at least one of the one or more components of the implement corresponding to at least one linkage joint;

at least one sensor associated with the at least one of the one or more components of the implement;

a controller functionally linked to the at least one sensor, the controller operable between a calibration mode and an operation mode;

where the controller is operated in the calibration mode, the controller configured to, rotate the at least one of the one or more components of the implement about an axis defined by the corresponding at least one linkage joint into one or more poses, for each of the one or more poses, perform at least one revolution of the implement about an axis substantially orthogonal to the frame of the work machine, wherein the axis is substantially orthogonal to a ground surface engaged by ground engaging units supporting the frame of the work machine, receive output signals from the at least one sensor, the output signals comprising sense elements, and track at least one characteristic based upon at least a portion of the sense elements from the received output signals for the at least one of the one or more components of the implement;

where the controller is operated in the operation mode, the controller configured to direct movement of the at least one of the one or more components of the implement based at least in part on the tracked at least one characteristic for the at least one of the one or more components of the implement.

16. The work machine of claim 15, further comprising a user interface configured to enable user selection between the calibration mode and the operation mode.

17. The work machine of claim 15, wherein:

the at least one characteristic comprises an orientation of the at least one of the one or more components of the implement with respect to the corresponding at least one linkage joint.

18. The work machine of claim 15, wherein:

the sense elements comprise a plurality of angular velocity measurements; and where the controller is in the calibration mode, the controller is configured to track at least one characteristic based upon at least a portion of the plurality of angular velocity measurements for the at least one of the one or more components of the implement.

19. The work machine of claim 15, wherein:

when the controller is operated in the calibration mode, the controller is configured to perform a first of the at least one revolution of the implement about the axis generally orthogonal to the frame at a rate of around one revolution per minute (RPM) or less.

20. The work machine of claim 19, wherein:

the controller is further configured to perform a second or more of the at least one revolution of the implement about the axis generally orthogonal to the frame at a rate greater than around one revolution per minute (RPM).

* * * * *